US010095142B2

(12) United States Patent
Hirai et al.

(10) Patent No.: US 10,095,142 B2
(45) Date of Patent: Oct. 9, 2018

(54) BRILLIANT TONER, ELECTROSTATIC CHARGE IMAGE DEVELOPER, AND TONER CARTRIDGE

(71) Applicant: FUJI XEROX CO., LTD., Tokyo (JP)

(72) Inventors: Sakiko Hirai, Kanagawa (JP); Satomi Hara, Kanagawa (JP); Masaru Takahashi, Kanagawa (JP); Atsushi Sugawara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/214,106

(22) Filed: Jul. 19, 2016

(65) Prior Publication Data

US 2017/0255117 A1 Sep. 7, 2017

(30) Foreign Application Priority Data

Mar. 2, 2016 (JP) ..... 2016-040253

(51) Int. Cl.

| | |
|---|---|
| ***G03G 9/087*** | (2006.01) |
| ***G03G 9/09*** | (2006.01) |
| ***G03G 9/08*** | (2006.01) |
| ***G03G 15/08*** | (2006.01) |

(52) U.S. Cl.

CPC ..... *G03G 9/0926* (2013.01); *G03G 9/0819* (2013.01); *G03G 9/08755* (2013.01); *G03G 9/0902* (2013.01); *G03G 15/0865* (2013.01)

(58) Field of Classification Search

CPC ..... G03G 9/0902; G03G 9/08755

See application file for complete search history.

(56) References Cited

U.S. PATENT DOCUMENTS

| | | | | |
|---|---|---|---|---|
| 6,200,718 | B1 * | 3/2001 | Takasaki | G03G 9/09314 399/297 |
| 2013/0130174 | A1 * | 5/2013 | Yamada | G03G 9/0815 430/137.14 |
| 2015/0111142 | A1 | 4/2015 | Tyagi et al. | |
| 2015/0139682 | A1 | 5/2015 | Ota | |
| 2015/0277252 | A1 * | 10/2015 | Takahashi | G03G 9/0823 430/109.1 |

FOREIGN PATENT DOCUMENTS

| | | |
|---|---|---|
| JP | 2003-207941 A | 7/2003 |
| JP | 2015-118358 A | 6/2015 |
| JP | 2015-523590 A | 8/2015 |

* cited by examiner

*Primary Examiner* — Peter L Vajda

(74) *Attorney, Agent, or Firm* — Oliff PLC

(57) ABSTRACT

A brilliant toner includes toner particles that contain a binder resin and a brilliant pigment which has a flake shape, wherein an average thickness of the brilliant pigment is greater than 0.5 μm to 1.5 μm.

17 Claims, 2 Drawing Sheets

BRILLIANT TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-040253 filed Mar. 2, 2016.

BACKGROUND

1. Technical Field

The present invention relates to a brilliant toner, an electrostatic charge image developer, and a toner cartridge.

2. Related Art

In recent years, usage of a brilliant toner containing a brilliant pigment for the purpose of forming an image with gloss such as metallic luster is examined.

SUMMARY

According to an aspect of the invention, there is provided a brilliant toner including:

toner particles that contain a binder resin and a brilliant pigment which has a flake shape, wherein an average thickness of the brilliant pigment is greater than 0.5 μm to 1.5 μm.

BRIEF DESCRIPTION OF THE DRAWINGS

Exemplary embodiments of the present invention will be described in detail based on the following figures, wherein.

DETAILED DESCRIPTION

Figure 1:
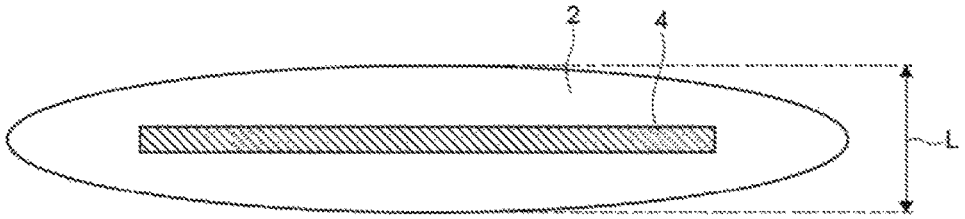
FIG. 1 is a sectional view schematically illustrating exemplary toner particles according to an exemplary embodiment.

Hereinafter, detailed description will be given of exemplary embodiments of a brilliant toner, an electrostatic charge image developer, a toner cartridge, a process cartridge, an image forming apparatus, and an image forming method according to an exemplary embodiment of the invention.

Brilliant Toner

A brilliant toner according to an exemplary embodiment (hereinafter, referred to as a "toner" in some cases) is a toner that includes toner particles containing a binder resin and a brilliant pigment which has a flake shape (hereinafter referred to as a flake-shaped brilliant pigment), in which an average thickness of the brilliant pigment is greater than 0.5 μm to 1.5 μm.

According to the toner of the exemplary embodiment, image contamination in an initial toner image due to the brilliant toner is prevented when the toner image is formed by using a toner other than the brilliant toner after successively forming brilliant toner images by using the brilliant toner. The reason thereof is not clear but is inferred as follows.

In the related art, there is a case in which a brilliant toner is unexpectedly placed on a toner image formed by using a toner other than the brilliant toner when the toner image is formed by using the toner (a black toner and a color toner, for example) other than the brilliant toner after successively forming brilliant toner images and the toner image formed by using the toner other than the brilliant toner is contaminated by the brilliant toner.

In particular, a sheet with high heat capacity, such as a so-called cardboard is applied as a recording medium used for forming a brilliant toner image. If brilliant toner images are successively formed on a sheet with high heat capacity, surface temperatures of a fixing roller and a fixing belt as fixing units provided in the image forming apparatus tend to decrease. If the surface temperatures of the fixing roller and the fixing belt decrease, fixation failure of the brilliant toner tends to occur, and the brilliant toner tends to remain on the surfaces of the fixing roller and the fixing belt, for example, in a state where the brilliant toner sticks onto the surfaces. Therefore, it is inferred that if a toner image is formed by using a toner other than the brilliant toner after successively forming brilliant toner images, the brilliant toner remaining on the surfaces of the fixing roller and the fixing belt adheres to the toner image formed by using the toner other than the brilliant toner and the toner image is contaminated by the brilliant toner. The phenomenon tends to occur in several toner images from the first toner image formed after successively forming the brilliant toner images.

The present inventors set an average thickness of the brilliant pigment contained in the brilliant toner within a predetermined range such that the brilliant toner hardly remains on the surfaces of the fixing roller and the fixing belt, as a result of intensive studies. As a result, it is inferred that usage of the toner according to the exemplary embodiment prevents image contamination in an initial toner image due to the brilliant toner when the toner image is formed by using a toner other than the brilliant toner after successively forming brilliant toner images by using the brilliant toner.

In the toner according to the exemplary embodiment, a toluene insoluble portion other than inorganic matters is preferably from 0.1% by weight to 50% by weight, more preferably from 2% by weight to 30% by weight, and further preferably from 3% by weight to 10% by weight with respect to the entire toner.

The toluene insoluble portion is adjusted, for example, by 1) a method of forming a crosslinked structure or a branched structure by adding a crosslinking agent to a polymer component having a reactive functional group at a terminal, 2) a method of forming a crosslinked structure or a branched structure by adding a polyvalent metal ion to a polymer component having an ionic functional group at a terminal, or 3) a method of extending or forming branches of a resin chain length by treating with an isocyanate or the like.

Here, the toluene insoluble portion is constituents except for inorganic matters in toner constituents which are insoluble in toluene. However, in a case in which a release agent is contained in the toner particles as well as the brilliant pigment and the binder resin, the toluene insoluble portion represents a toluene insoluble portion other than the inorganic matters and the release agent. That is, the toluene insoluble portion represents an insoluble portion that contains binder resin components which are insoluble in toluene (high-molecular weight components of the binder resin, in particular) as main components (equal to or greater than 90% by weight with respect to the entirety, for example). A non-brilliant pigment, an external additive, and the like as well as the brilliant pigment correspond to the inorganic matters.

The toluene insoluble portion is a value measured by the following method.

First, the toner as a target of measurement is embedded by using a bisphenol A-type liquid epoxy resin and a curing agent, and a sample to be cut is then created. Then, a cutting machine using a diamond knife such as UltracutUCT (manufactured by Leica) is used to cut the sample into pieces at −100° C.

A section of the sample cut into pieces is observed by a scanning electron microscope with an energy dispersed-type X-ray analyzer (SEM-EDX), and constituent elements of inorganic matters (the flake-shaped brilliant pigment (observed in a needle shape in the section) and external additive in a case in which the external additive is externally added to the toner particles) that are present in the toner are identified by the energy dispersed-type X-ray analyzer (EDX). Then, the amount (% by weight) of the inorganic matters is determined by a fluorescent X-ray analyzer.

Here, an electron microscope "S-4100" manufactured by Hitachi, Ltd. with an energy dispersed-type X-ray analyzer "EMAX model 6923H" manufactured by Horiba, Ltd. is used as the scanning electron microscope with the energy dispersed-type X-ray analyzer, and an accelerating voltage is set to 20 kV as a measurement condition. In contrast, a "fluorescent X-ray analyzer XRF-1500" manufactured by Shimadzu Corporation is used as a fluorescent X-ray analyzer, and a tube voltage is set to 40 kV, a tube current is set to 90 mA, and a measurement time is set to 5 minutes as the measurement conditions.

In contrast, 1 g of weighed toner is put into a cylindrical filter paper made of weighed glass fiber and is attached to an extraction tube of a heating-type Soxhlet extractor. Then, toluene is poured into a flask and is heated at 110° C. by using a mantle heater. In addition, a periphery of the extraction tube is heated at 125° C. by using a heater attached to the extraction tube. Extraction is performed at such a reflux speed that one extraction cycle is performed within a range from 4 minutes to 5 minutes. After the extraction for 10 hours, the cylindrical filter paper and toner residual are extracted, dried, and weighed.

Then, the toner residual amount (% by weight) is calculated based on an equation: toner residual amount (% by weight)=[(amount of cylindrical filter paper+toner residual amount) (g)−amount of cylindrical filter paper (g)]/weight of toner (g)×100. The toner residual includes inorganic matters such as the brilliant pigment and the external additive and toluene insoluble portion. In a case in which the toner particles contain a release agent, the release agent corresponds to toluene soluble since extraction by heating is performed.

Then, the toluene insoluble portion (% by weight) is calculated from "the amount (% by weight) of the inorganic matters (the brilliant pigment and an external additive in a case in which the external additive is externally added) by quantification by the fluorescent X-ray analyzer and "the toner residual amount (% by weight)" extracted by the heating Soxhlet extractor. That is, the toluene insoluble portion (% by weight) is calculated from an equation "toluene insoluble portion (% by weight)"="toner residual amount (% by weight)" −"amount of inorganic matters (% by weight)".

In the toner according to the exemplary embodiment, "brilliance" means gloss such as metallic luster when an image formed by the brilliant toner is viewed.

Specifically, the toner according to the exemplary embodiment preferably has a ratio (X/Y) from 2 to 100 between reflectance X at a light receiving angle of +30° and reflectance Y at a light receiving angle of −30° measured in a case in which a solid image is formed and the image is irradiated with incident light with an incident angle of −45° by a variable-angle photometer.

The ratio (X/Y) of equal to or greater than 2 represents that reflection on the opposite side (positive angle side) to the incident side is greater than reflection on the incident side (minus angle side) on which the incident light is incident, that is, scattered reflection of the incident light is prevented. In a case in which scattered reflection of incident light in various directions occurs, the reflected light is observed to have a dull-hued color in visual recognition. Therefore, there is a case in which luster cannot be observed in the visual recognition of the reflected light and brilliance deteriorates if the ratio (X/Y) is less than 2.

In contrast, if the ratio (X/Y) exceeds 100, there is a case in which a viewing angle in which the reflected light may be visually recognized becomes excessively narrow and a blackish color is observed depending on a viewing angle due to a large regular reflected light component.

The ratio (X/Y) is preferably from 4 to 50, more preferably from 6 to 20, and particularly preferably from 8 to 15 in terms of brilliance and toner manufacturability. Measurement of ratio (X/Y) by variable-angle photometer Here, description will be given first of the incident angle and the light receiving angle. In the measurement by the variable-angle photometer in the exemplary embodiment, the incident angle is set to −45° since high measurement sensitivity is achieved with respect to images with glossiness in a wide range.

The light receiving angle is set to −30° and +30 since the highest measurement sensitivity is achieved in evaluation of images with glossy feeing and images with no glossy feeling.

Next, description will be given of a method of measuring the ratio (X/Y).

A stereoscopic variable-angle colorimeter GC5000L manufactured by Nippon Denshoku Industries Co., Ltd. is used as a varied-angle photometer to cause incident light at an incident angle of −45° with respect to an image as a measurement target (brilliant image) to be incident on the image, and the reflectance X at the light receiving angle of +30° and the reflectance Y at the light receiving angle of −30° are measured. The reflectance X and the reflectance Y are measured from light with wavelengths in a range from 400 nm to 700 nm at an interval of 20 nm, and average values of the reflectance at the respective wavelengths are obtained. The ratio (X/Y) is calculated from these measurement results.

The toner according to the exemplary embodiment preferably satisfies the following requirements (1) and (2) from a viewpoint of satisfying the above ratio (X/Y).

(1) An average equivalent circle diameter D is greater than an average maximum thickness C of the toner particles.

(2) A rate of brilliant pigment with angles in a range from −30 to +30° between a longitudinal axis direction in sections of the toner particles in a thickness direction and a longitudinal axis direction of the brilliant pigment in observation thereof is equal to or greater than 60% of the entire brilliant pigment observed.

It is considered that if the toner particles have a flake shape in which the thickness is longer than the equivalent circle diameter (see FIG. 1), then the flake surface side of the flake-shaped toner particles are aligned so as to face the surface of the recording medium in a fixation process for forming an image due to pressure during the fixation. In FIG. 1, 2 represents the toner particles, 4 represents the brilliant pigment, and L represents the thickness of the toner particles.

Therefore, it is considered that a side of the maximum area surface of the brilliant pigment, which satisfies the above requirement (2) "angles are in a range from −30 to +30° between a longitudinal axis direction in sections of the toner and a longitudinal axis direction of the brilliant pigment", in the flake-shaped (flaky) brilliant pigment contained in the toner particles is aligned so as to face the surface of the recording medium. It is considered that the above range of ratio (X/Y) is achieved since the rate of the brilliant pigment reflected in a scattered manner is prevented with respect to the incident light in a case of causing light to be incident on the thus formed image.

Hereinafter, detailed description will be given of the toner according to the exemplary embodiment.

The toner according to the exemplary embodiment includes toner particles that contain at least a binder resin and a flake-shaped brilliant pigment. The toner particles according to the exemplary embodiment may contain other components as needed.

The toner according to the exemplary embodiment may include toner particles containing a brilliant pigment and a binder resin and an external additive that is externally added to the toner particles.

Toner Particles

The toner particles contain the binder resin and the flake-shaped brilliant pigment. The toner particles may contain other additives such as a release agent as needed.

Binder Resin

Examples of the binder resin include vinyl resin including a homopolymer of a monomer such as styrenes (such as styrene, parachlorostyrene, or α-methylstyrene), (meth) acrylic acid esters (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate), ethylenic unsaturated nitriles (such as acrylonitrile, or methacrylonitrile), vinyl ethers (such as vinyl methyl ether, or vinyl isobutyl ether), vinyl ketones (vinyl methyl ketone, vinyl ethyl ketone, or vinyl isopropenyl ketone), or olefins (such as ethylene, propylene, or butadiene) or a copolymer of two or more kinds of such monomers.

Examples of the binder resin also include a non-vinyl resin such as an epoxy resin, a polyester resin, a polyurethane resin, a polyamide resin, a cellulose resin, a polyether resin, a modified rosin, a mixture of such a non-vinyl resin and the above-described vinyl resin, and a graft polymer obtained by polymerizing a vinyl monomer in the presence of anyone of these resins.

One kind or two or more kinds of such binder resins may be used alone or in combination.

A polyester resin is preferably used as the binder resin.

Examples of the polyester resin include known polyester resin.

Examples of the polyester resin include a condensation polymer of a polyvalent carboxylic acid and a polyol. A commercially available polyester resin or synthesized polyester resin may be used.

Examples of the polyvalent carboxylic acid include aliphatic dicarboxylic acid (such as oxalic acid, malonic acid, maleic acid, fumaric acid, citraconic acid, itaconic acid, glutaconic acid, succinic acid, alkenyl succinic acid, adipic acid, or sebacic acid), alicyclic carboxylic acid (such as cyclohexane dicarboxylic acid), aromatic dicarboxylic acid (such as terephthalic acid, isophthalic acid, phtalic acid, or naphthalenedicarboxylic acid), anyhydride thereof, or lower alkyl ester (containing 1 to 5 carbon atoms, for example) thereof. Among the examples, aromatic dicarboxylic acid, for example, is preferably used as polyvalent carboxylic acid.

As the polyvalent carboxylic acid, trivalent or more carboxylic acid with a crosslinked structure or a branched structure may be used with dicarboxylic acid. Examples of the trivalent or more carboxylic acid include trimellitic acid, pyromellitic acid, anhydride thereof, or lower alkyl ester (containing 1 to 5 carbon atoms, for example) thereof.

One kind or two or more kinds of polyvalent carboxylic acid may be used alone or in combination.

Examples of the polyol include aliphatic diol (such as ethylene glycol, diethylene glycol, triethylene glycol, propylene glycol, butanediol, hexanediol, or neopentyl glycol), alicyclic diol (such as cyclohexanediol, cyclohexanedimethanol, hydrogenated bisphenol A), aromatic diol (such as ethylene oxide adduct of bisphenol A or propylene oxide adduct of bisphenol A). Among the examples, an aromatic diol and an alicyclic diol are preferably used, and an aromatic diol is more preferably used as the polyol.

As the polyol, a trivalent or more polyvalent alcohol having a crosslinked structure or a branched structure may be used in combination with diol. Examples of the trivalent or more polyvalent alcohol include glycerine, trimethylol propane, and pentaerythritol.

One kind or two or more kinds of polyols may be used alone or in combination.

The glass transition temperature (Tg) of the polyester resin is preferably from 50° C. to 80° C., and more preferably from 50° C. to 65° C.

The glass transition temperature is determined by a DSC curve obtained by a differential scanning calorimetry (DSC). More specifically, the glass transition temperature is determined based on "Extrapolation glass transition onset temperature" described in how to determine glass transition temperature in JIS K 7121-1987 "Method of measuring plastic transition temperature".

The weight average molecular weight (Mw) of the polyester resin is preferably from 5,000 to 1,000,000, and more preferably from 7,000 to 500,000.

The number average molecular weight (Mn) of polyester resin is preferably from 2,000 to 100,000.

The molecular weight distribution Mw/Mn of polyester resin is preferably from 1.5 to 100, and more preferably from 2 to 60.

The weight average molecular weight and the number average molecular weight are measured by gel permeation chromatography (GPC). The molecular weight measurement by the GPC is performed by using GPC·HLC-8120GPC manufactured by Tosoh Corporation as a measurement apparatus, a column TSKgel SuperHM-M (15 cm) manufactured by Tosoh Corporation, and THF solvent. The weight average molecular weight and the number average molecular weight are calculated by using a molecular weight calibration curve created by a mono-dispersed polystyrene standard sample from the measurement result.

The polyester resin is obtained by a known preparing method. Specifically, the polyester resin is obtained by a method of setting a polymerization temperature to be from 180° C. to 230° C., for example, reducing a pressure in a reaction system as needed, and causing a reaction while removing water and alcohol that are generated during condensation.

In a case in which monomer of the raw materials are not dissolved or blended at the reaction temperature, a solvent with a high boiling point may be added as a solubilizer to promote the dissolution. In such a case, the polycondensation reaction is performed while evaporating the solubilizer. In a case in which monomer with low compatibility is present in the copolymerization reaction, it is preferable to condense the monomer with low compatibility and acid or alcohol to be polycondensed with the monomer in advance and then cause polycondensation with main constituents.

Here, examples of polyester resin other than the aforementioned non-modified polyester resin include modified polyester resin. Modified polyester resin is polyester resin in which a linking group other than ester linking is present or polyester resin in which a different resin component from the polyester resin component is bonded by covalent bond or ion bond. Examples of the modified polyester include a resin having a modified terminal prepared by causing a polyester resin with a terminal having a functional group, which reacts with an acid group or a hydroxyl group, such as isocyanate group, to react with an active hydrogen compound.

Urea-modified polyester resin is particularly preferable as the modified polyester resin. Inclusion of urea-modified polyester resin as the binder resin facilitates prevention of occurrence of damage in the fixing member due to the brilliant pigment. This is considered to be because urea-modified polyester has appropriate hydrophilicity and is arranged in the toner particles so as to surround the edge portion of the brilliant pigment as toluene insoluble portion. On this point, the content of the urea-modified polyester resin is preferably from 10% by weight to 30% by weight, and more preferably from 15% by weight to 25% by weight with respect to the entire binder resin.

As the urea-modified polyester resin, urea-modified polyester resin obtained by a reaction (at least one of a cross-linking reaction and an elongation reaction) between polyester resin (polyester prepolymer) having isocyanate groups and an amine compound. The urea-modified polyester may contain urethane bond with urea bond.

Polyester prepolymer having isocyanate groups is a polyester that is a polycondensate of a polyvalent carboxylic acid and a polyol, and examples thereof include prepolymer obtained by causing a reaction between polyester with active hydrogen and a polyvalent isocyanate compound. Examples of the group with active hydrogen included in polyester includes a hydroxyl group (alcoholic hydroxyl group and a phenolic hydroxyl group), an amino group, a carboxyl group, and a mercapto group, and an alcoholic hydroxyl group is preferably used.

Examples of the polyvalent carboxylic acid and the polyol in the polyester prepolymer having isocyanate groups include similar compounds as those of the polyvalent carboxylic acid and the polyol described in relation to the polyester resin.

Examples of the polyvalent isocyanate compound include: aliphatic polyisocyanate (such as tetramethylene diisocyanate, hexamethylene diisocyanate, Or 2,6-diisocyanatemethylcaproate); alicyclic polyisocyanate (such as isophoronediisocyanate, cyclohexylmethanediisocyanate), aromatic diisocyanate (tolylene diisocyanate or diphenylmethane diisocyanate); aromatic-aliphatic diisocyanate ($\alpha$, $\alpha$, $\alpha'$, $\alpha'$-tetramethyl xylylene diisocyanate); isocyanurates; and those prepared by blocking the above-described polyisocyanate with a blocking agent such as a phenol derivative, oxime, or caprolactam.

For the polyvalent isocyanate compound, one or two or more kinds of blocking agent may be used alone or in combination.

As for a ratio of the polyvalent isocyanate compound, an equivalent ratio [NCO]/[OH] between an isocyanate group [NCO] and a hydroxyl group [OH] in polyester prepolymer having an hydroxyl group is preferably from 1/1 to 5/1, more preferably from 1.2/1 to 4/1, and further preferably from 1.5/1 to 2.5.1. If [NCO]/[OH] is set to be from 1/1 to 5/1, tendency that the toluene insoluble portion is within the above range increases, and occurrence of damage in the fixing member due to the brilliant pigment tends to be prevented. If [NCO]/[OH] is set to be equal to or less than 5, degradation in the low-temperature fixing property tends to be prevented.

In polyester prepolymer having isocyanate groups, the content of a component derived from a polyvalent isocyanate compound is preferably from 0.5% by weight to 40% by weight, more preferably from 1% by weight to 30% by weight, and further preferably from 2% by weight to 20% by weight with respect to the entire polyester prepolymer having isocyanate group. If the content of the component derived from polyvalent isocyanate is set to be from 0.5% by weight to 40% by weight, the tendency that the toluene insoluble portion is within the above range increases, and occurrence of damage in the fixing member due to the brilliant pigment tends to be prevented. If the content of the component derived from polyvalent isocyanate is set to be equal to or less than 40% by weight, degradation in the low-temperature fixing property tends to be prevented.

The number of isocyanate groups contained in one molecule of the polyester prepolymer having isocyanate groups is preferably equal to or greater than 1 on average, more preferably from 1.5 to 3 on average, and further preferably from 1.8 to 2.5 on average. If the number of isocyanate groups per a molecule is set to be equal to or more than 1, the molecular weight of the urea-modified polyester resin after the reaction increases, the tendency that the toluene insoluble portion is within the above range increases, and occurrence of the damage in the fixing member due to the brilliant pigment tends to be prevented.

Examples of the amine compound to be reacted with polyester prepolymer having isocyanate groups include diamine, trivalent or more polyamine, amino alcohol, amino mercaptan, amino acid, and a compound obtained by blocking an amino group thereof.

Examples of diamine include aromatic diamine (phenylenediamine, diethyltoluenediamine, or 4,4'-diaminodphenylmethane); alicyclic diamine (such as 4,4-diamino-3,3'-dimethyldicyclohexylmethane, diaminecyclohexane, or isophoronediamine); and aliphatic diamine (such as ethylenediamine, tetramethylenediamine, or hexamethylenediamine).

Examples of trivalent or more polyamine include diethylenetriamine and triethylenetetramine.

Examples of amino alcohol include ethanolamine and hydroxyethylaniline.

Examples of amino mercaptan include aminoethylmercaptan and aminopropylmercaptan.

Examples of amino acid include aminopropionic acid and aminocaproic acid.

Examples of the compound obtained by blocking an amino group thereof include a ketimine compound obtained from an amine compound such as diamine, trivalent or more polyamine, amino alcohol, amino mercaptan, or amino acid and a ketone compound (such as acetone, methylethylketone, or methylisobutylketone) and an oxazoline compound.

Among these amine compounds, a ketimine compound is preferably used.

One kind or two or more kinds of the amine compounds may be used alone or in combination.

The urea-modified polyester resin may be resin having a molecular weight adjusted after a reaction by adjusting the reaction between the polyester resin having isocyanate groups (polyester prepolymer) and the amine compound (at least one of a crosslinking reaction and an elongation reaction) with a terminator (hereinafter, also referred to as a "crosslinking/elongation reaction terminator") for stopping at least one of the crosslinking reaction and the elongation reaction.

Examples of the crosslinking/elongation reaction terminator include monoamine (such as diethylamine, dibutylamine, butylamine, or laurylamine) and a substance (ketimine compound) obtained by blocking monoamine.

As for a ratio of the amine compound, an equivalent ratio [NCO]/[NHx] of isocyanate groups [NCO] in polyester prepolymer having isocyanate groups and amino groups [NHx] in amines is preferably from 1/2 to 2/1, more preferably from 1/1.5 to 1.5/1, and further preferably from 1/1.2 to 1.2/1. If [NCO]/[NHx] is set within the above range, the molecular weight of the urea-modified polyester resin after the reaction increases, the tendency that the toluene insoluble portion is within the above range increases, and occurrence of damage in the fixing member due to the brilliant pigment tends to be prevented.

The glass transition temperature of the urea-modified polyester resin is preferably from 40° C. to 65° C., and further preferably from 45° C. to 60° C. The number average molecular weight is preferably from 2,500 to 50,000, and further preferably from 2,500 to 30,000. The weight average molecular weight is from 10,000 to 500,000, and further preferably from 30,000 to 100,000.

The content of the binder resin is preferably from 40% by weight to 95% by weight, more preferably from 50% by weight to 90% by weight, and further preferably from 60% by weight to 85% by weight.

Brilliant Pigment

Examples of the brilliant pigment includes a pigment that may apply glossy feeling like metallic luster. Specific examples of the brilliant pigment include: a metal pigment including powder of metal such as aluminum (metal of Al alone), brass, bronze, nickel, stainless steel, or zinc; mica that covers titanium oxide, yellow iron oxide, or the like; an inorganic crystal substrate having a thin flaky shape covered with barium sulfate, layer silicate, silicate of layer aluminum; single crystal plate-shaped titanium oxide; basic carbonate; bismuth acid oxychloride; natural guanine; thin-flaky glass powder; and metal deposited thin-flaky glass powder, and there is no particular limitation as long as the pigment exhibits brilliance.

Among the examples of the brilliant pigment, a metal pigment is preferably used, and particularly, an aluminum pigment is the most preferably used in terms of specular reflection intensity.

The shape of the brilliant pigment is a flake shape (flaky shape).

The average thickness of the brilliant pigment is greater than 0.5 μm to 1.5 μm, preferably from 0.7 μm to 1.5 μm, and more preferably from 1.0 μm to 1.5 μm. The average thickness of the brilliant pigment is also greater than 0.5 μm to 1.5 μm, preferably greater than 0.5 μm to 1.2 μm, and more preferably greater than 0.5 μm to 1.0 μm.

If the average thickness of the brilliant pigment is equal to or less than 0.5 μm, the brilliant pigment tends to remain on the surfaces of the fixing rollers and the fixing belts as fixing units. In contrast, if the average thickness of the brilliant pigment is greater than 1.5 μm, it becomes difficult to charge the brilliant toner, and an initial developing property deteriorates.

The volume average particle diameter of the brilliant pigment is preferably from 1.0 μm to 25 μm, more preferably from 2.0 μm to 20 μm, and further preferably from 3.0 μm to 15 μm.

The average length of the brilliant pigment in the longitudinal axis direction is preferably from 1.0 μm to 25 μm, more preferably from 2.0 μm to 20 μm, and further preferably from 3.0 μm to 15 μm.

A ratio (aspect ratio) of the average length of the brilliant pigment in the longitudinal axis direction on the assumption that an average length thereof in a thickness direction is 1 is preferably from 3 to 40, more preferably from 5 to 35, and further preferably from 8 to 30.

The upper GSD of an average thickness of the brilliant pigment is preferably equal to or less than 1.4, more preferably equal to or less than 1.35, and further preferably equal to or less than 1.3.

The lower GSD of the average thickness of the brilliant pigment is preferably equal to or less than 1.4, more preferably equal to or less than 1.35, and further preferably equal to or less than 1.3.

The average thickness, the average length in the longitudinal axis direction, the aspect ratio, the upper GSD of the average thickness, and the lower GSD of the average thickness of the brilliant pigment are values measured by the following methods.

By fixing brilliant toner to a recording medium such as a sheet of paper at a toner applied amount of 3 g/m$^2$ and forming a brilliant toner image, a plane direction of the brilliant pigment contained in the brilliant toner is directed along a plane direction of the recording medium. The brilliant toner image is embedded by using bisphenol A-type liquid epoxy resin and a curing agent, and a sample to be cut is then created. Next, a cutting machine using a diamond knife, such as an ultramicrotome apparatus (UltracutUCT manufactured by Leica), is used to cut the sample to be cut, and a sample to be observed is created. The sample to be observed is observed with a transmission electron microscope (TEM), and the thickness and the length in the longitudinal axis direction of 100 pieces of brilliant pigment are obtained. As for magnification, such a magnification that about one to ten pieces of brilliant pigment are viewed in a single field of view is employed for the observation. The average thickness, the average length in the longitudinal axis direction, the aspect ratio, the upper GSD of the average thickness, and the lower GSD of the average thickness of the brilliant pigment are calculated from the obtained values.

The length of the brilliant pigment in the longitudinal axis direction is a diameter of a circumscribed circle of a section of the brilliant pigment. The thickness of the brilliant pigment is a maximum thickness of the brilliant pigment in a direction orthogonal to the diameter of the circumscribed circle of the section of the brilliant pigment.

The upper GSD and the lower GSD of the average thickness are calculated on the assumption that $(T84/T50)^{1/2}$ is the upper GSD and $(T50/T16)^{1/2}$ is the lower GSD when cumulative distribution of the thickness of the 100 pieces of brilliant pigment measured is depicted from thinner thickness on a number basis, the thickness corresponding to accumulation of 16% is T16, the thickness corresponding to accumulation of 50% is T50, and the thickness corresponding to accumulation of 84% is T64.

The volume average particle diameter of the brilliant pigment is defined as a particle diameter corresponding to accumulation of 50% obtained by depicting cumulative distribution from a smaller diameter side on a volume basis in a particle diameter range (channel) divided based on particle diameter distribution that is measured by a measurement apparatus such as MULTISIZER II (manufactured by Beckman Coulter, Inc.).

A method of extracting the brilliant pigment from the brilliant toner is not particularly limited, and for example, the brilliant pigment may be extracted by putting the brilliant toner into a solvent (such as tetrahydrofuran) with a binder resin dissolved therein, dissolving the binder resin, precipitating the brilliant pigment by a centrifugation process, and collecting the brilliant pigment. In a case in which the brilliant toner contains an external additive added thereto, the external additive may be removed from the toner by an ultrasonic process as preprocessing before the brilliant toner is put into the solvent.

The content of the brilliant pigment is preferably from 1 part by weight to 50 parts by weight, and more preferably from 15 parts by weight to 25 parts by weight with respect to 100 parts by weight of the toner particles, for example.

Release Agent

Examples of the release agent include hydrocarbon wax; natural wax such as carnauba wax, rice wax, or candelilla wax; synthesized, mineral, or petroleum wax such as montan wax; and ester wax such as fatty acid ester or montanic acid ester. The release agent is not limited thereto.

The melting temperature of the release agent is preferably from 50° C. to 110° C., and more preferably from 60° C. to 100° C.

The melting temperature is obtained based on "Melting peak temperature" described in how to obtain a melting temperature in JIS K 7121-1987 "Method of measuring plastic transition temperature" from a DSC curve obtained by a differential scanning calorimetry (DSC).

The content of the release agent is preferably from 1% by weight to 20% by weight, and more preferably from 5% by weight to 15% by weight with respect to the entire toner particles, for example.

Other Additives

Examples of other additives include known additives such as a coloring agent other than a magnetic material, a charge-controlling agent, inorganic particles, and the brilliant pigment. Such additives are contained in the toner particles as an internal additive.

Examples of the charge-controlling agent include a dye containing a complex of a quaternary ammonium salt compound, a nigrosine compound, aluminum, iron, or chromium and a triphenylmethane pigment.

As the inorganic particles, one kind or two or more kinds of known inorganic particles such as silica particles, titanium oxide particles, alumina particles, cerium oxide particles, or particles obtained by treating the surfaces thereof with a hydrophobizing agent may be used alone or in combination. Among these examples, silica particles with lower refractive index than that of the binder resin are preferably used. In addition, various kinds of surface treatment may be performed on the silica particles, and for example, silica particles whose surfaces are treated with a silane coupling agent, a titanium coupling agent, or silicone oil, for example, are preferably used.

Examples of the coloring agent other than the brilliant pigment include known coloring agents, and selection is made in accordance with a targeted color tone. As other coloring agent, a coloring agent whose surface has been treated may be used as needed, or the coloring agent may be used with a dispersant.

Properties of Toner Particles

The toner particles may be toner particles with a single layer structure or may be toner particles with a so-called core shell structure formed of a core (core particle) and a covering layer (shell layer) covering the core.

It is preferable that the toner particles with the core shell structure is formed of a core containing the brilliant pigment and the binder resin, and if necessary, other additives such as a release agent, and a covering layer containing the binder resin.

Average maximum thickness C and average equivalent circle diameter D of toner particles The toner particles have a flake shape, and the average maximum thickness C is preferably longer than the average equivalent circle diameter D. It is more preferable that the ratio (C/D) of the average maximum thickness C and the average equivalent circle diameter D is within the range from 0.001 to 0.700, it is further preferable that the ratio is within the range from 0.100 to 0.600, and it is particularly preferable that the ratio is within the range from 0.300 to 0.450.

If the ratio (C/D) is equal to or greater than 0.001, strength of the toner is secured, breakage due to a stress during image formation is prevented, decrease in charge and thus occurring blushing due to exposure of the pigment are prevented. On the other hand, if the ratio is equal to or less than 0.700, excellent brilliance may be achieved.

The average maximum thickness C and the average equivalent circle diameter D are measured by the following method.

The toner particles are placed on a flake surface and are then dispersed without irregularity by applying vibration thereto. The average maximum thickness C and the average equivalent circle diameter D are calculated by using a color laser microscope "VK-9700" (manufactured by Keyence Corporation) to magnify 1000 toner particles 1000 times, measuring the maximum thickness C of the brilliant toner particles and the equivalent circle diameter D of the plane when viewed from the upper side, and obtaining arithmetic mean values thereof.

Angle Between Longitudinal Axis Direction in Section of Toner Particle and Longitudinal Direction of Brilliant Pigment In a case of observing a section of a toner particle in the thickness direction, a rate (number basis) of the brilliant pigment with an angle in the range from −30° to +30° between the longitudinal axis direction in the section of the toner particle and the longitudinal direction of the brilliant pigment is preferably equal to or greater than 60% with respect to the entire brilliant pigment observed. Furthermore, the above rate is further preferably from 70% to 95%, and particularly preferably from 80% to 90.

If the above rate is equal to or greater than 60%, more excellent brilliance may be achieved.

Here, description will be given of a method of observing the section of the toner particle.

The toner particles are embedded by using bisphenol A-type liquid epoxy resin and a curing agent, and a sample to be cut is then created. Next, a cutting machine using a diamond knife, such as an ultramicrotome apparatus (UltracutUCT manufactured by Leica), is used to cut the sample to be cut at −100°, and a sample to be observed is created. The sample to be observed is observed at such a magnification that about 1 to ten toner particles may be viewed in a single field of view by using an ultra-high resolution field emission-type scanning electron microscope (S-4800 manufactured by Hitachi High-Technologies Corporation), for example.

Specifically, the section (the section of the toner particle in the thickness direction) of the toner particle is observed, the number of pieces of the brilliant pigment with an angle in the range from −30° to +30° between the longitudinal axis direction in the section of the toner particle and the longitudinal direction of the brilliant pigment among the 100 toner particles observed is counted by using image analysis software such as image analysis software (WinROOF) manufactured by Mitani Corporation, for example, or an output sample of the observed image and a protractor, and the rate thereof is calculated.

The "longitudinal axis direction in the section of the toner particle" represents a direction orthogonal to the thickness direction of the above toner particle with a longer average equivalent circle diameter D than the average maximum thickness C, and the "longitudinal axis direction of the brilliant pigment" represents a length direction of the brilliant pigment.

The volume average particle diameter of the toner particles is preferably from 3 μm to 30 μm, and more preferably from 5 μm to 20 μm.

The ratio (D50(pig)/D50(tn)) of a volume average particle diameter (D50 (pig)) of the brilliant pigment and a volume average particle diameter (D50 (tn)) of the toner particles is preferably from 0.46 to 0.93.

The volume average particle diameter D50v of the toner particles is obtained by depicting cumlative distribution for the volume and the number from the smaller diameter side, respectively, in divided particle diameter ranges (channels) based on particle diameter distribution measured by a measurement apparatus such as MULTISIZER II (manufactured by Beckman Coulter, Inc.). The particle diameter corresponding to accumulation of 16% is defined to have a volume $D_{16v}$ and a number $D_{16p}$, a particle diameter corresponding to accumulation of 50% is defined to have a volume $D_{50v}$ and a number $D_{50p}$, and a particle diameter corresponding to accumulation of 84% is defined to have a volume $D_{84v}$ and a number $D_{84p}$. The volume $D_{84p}$ particle diameter distribution index (GSDv) is calculated as $(D_{84v}/D_{16v})^{1/2}$ by using the values.

A ratio (aspect ratio) of an average length in the longitudinal axis direction on the assumption that the average length of the toner particles in the thickness direction is 1 is preferably from 3 to 15, and more preferably from 5 to 12.

As the average length in the thickness direction and the average length in the longitudinal axis direction of the toner particles, average values of the lengths in the thickness direction and the lengths in the longitudinal axis direction of 100 respective toner particles measured by the above method of observing the sections of the toner particles are employed.

The ratio (A(pig)/A(tn)) of an aspect ratio (A(pig)) of the brilliant pigment and an aspect ratio (A(tn)) of the toner particles is preferably from 0.71 to 6.08.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, CaO—$SiO_2$, $K_2O$— $(TiO_2)$ n, $Al_2O_3.2SiO_2$, $CaCO_3$, $MgCO_3$, $BaSO_4$, and $MgSO_4$.

It is preferable that the surfaces of the inorganic particles as the external additive is treated with a hydrophobizing agent. The treatment with the hydrophobizing agent is performed by dipping the inorganic particles in a hydrophobizing agent, for example. Although the hydrophobizing agent is not particularly limited, examples thereof include a silane coupling agent, silicone oil, a titanate coupling agent, and an aluminum coupling agent. One kind or two or more kinds of the hydrophobizing agents may be used alone or in combination.

The amount of the hydrophobizing agent is typically from 1 part by weight to 10 parts by weight with respect to 100 parts by weight of the inorganic particles, for example.

Examples of the external additive also include resin particles (resin particles of polystyrene, polymethyl methacrylate (PMMA), melamine resin, or the like) and a cleaning aid (metal salt of higher fatty acid, representative examples of which include zinc stearate, and particles of fluorine high-molecular-weight material).

The amount of the external additive is preferably from 0.01% by weight to 5% by weight, and more preferably from 0.01% by weight to 2.0% by weight with respect to the amount of the toner particles, for example.

Preparing Method of Toner

Next, description will be given of a preparing method of the toner according to the exemplary embodiment.

The toner according to the exemplary embodiment is obtained by preparing the toner particles containing the brilliant pigment and then externally adding the external additive to the toner particles.

The toner particles may be prepared by any of a dry manufacturing method (such as a kneading and pulverizing method) and a wet manufacturing method (such as an aggregating and coalescing method, a suspension polymerization method, or a dissolution suspension method). The preparing method of the toner particles is not limited to these manufacturing methods, and a known manufacturing method is employed.

For example, the dissolution suspension method is a method of preparing and obtaining the toner particles by removing an organic solvent after dispersing, in a water-based solvent containing a particle dispersant, a solution obtained by dissolving or dispersing raw materials that form the toner particles (such as the resin particles and the brilliant pigment) in the organic solvent in which the binder resin may be dissolved.

In addition, the aggregating and coalescing method is a method of obtaining the toner particles by performing an aggregating process for forming an aggregate of the raw materials that form the toner particles (the resin particles, the brilliant pigment, and the like) and a coalescing process of coalescing the aggregate.

It is preferable that the toner particle containing the urea-modified polyester resin as the binder resin is obtained by the dissolution suspension method described below, from among these manufacturing methods. Although a method of obtaining toner particles containing a release agent will be described in the following description of the dissolution suspension method, the release agent is contained in the toner particles as needed. Although a method of obtaining toner particles containing unmodified polyester resin and urea-modified polyester resin as a binder resin will be described, the toner particles may contain only the urea-modified polyester resin as the binder resin.

Process for Preparing Oil Phase Solution

An oil phase solution is prepared in which materials of toner particles including unmodified polyester resin, polyester prepolymer having isocyanate groups, an amine compound, brilliant pigment, and a release agent are dissolved or dispersed in an organic solvent (process for preparing oil phase solution). The process for preparing an oil phase solution is a process for obtaining a mixture solution of the toner materials by dissolving or dispersing the toner particle materials in the organic solvent.

Examples of methods of preparing the oil phase solution include 1) a method of preparing the oil phase solution by collectively dissolving or dispersing the toner materials in the organic solvent, 2) a method of preparing the oil phase solution by kneading the toner materials in advance and then dissolving or dispersing the kneaded materials in the organic solvent, 3) a method of preparing the oil phase solution by dissolving the unmodified polyester resin, the polyester prepolymer having isocyanate groups, and the amine compound in the organic solvent and then dispersing the brilliant pigment and the release agent in the organic solvent, 4) a method of preparing the oil phase solution by dispersing the brilliant pigment and the release agent in the organic solvent and then dissolving the unmodified polyester resin, the polyester prepolymer having isocyanate groups, and the amine compound in the organic solvent, 5) a method of preparing the oil phase solution by dissolving or dispersing toner particle materials (the unmodified polyester resin, the brilliant pigment, and the release agent) other than the polyester prepolymer having isocyanate groups and the amine compound in the organic solvent and then dissolving the polyester prepolymer having isocyanate groups and the amine compound in the organic solvent, and 6) a method of preparing the oil phase solution by dissolving or dispersing toner particle materials (the unmodified polyester resin, the brilliant pigment, and the release agent) other than the polyester prepolymer having isocyanate groups or the amine compound and then dissolving the polyester prepolymer having isocyanate groups or the amine compound in the organic solvent. The method of preparing the oil phase solution is not limited thereto.

Examples of the organic solvent for the oil phase solution include: an ester solvent such as methyl acetate or ethyl acetate; a ketone solvent such as methyl ethyl ketone or methyl isopropyl ketone; an aliphatic hydrocarbon solvent such as hexane or cyclohexane; and a halogenated hydrocarbon such dichloromethane, chloroform, or trichloroethylene. Such an organic solvent preferably dissolves the binder resin, is preferably dissolved in water at a rate from 0% by weight to 30% by weight, and preferably has a boiling point of equal to or less than 100° C. Ethyl acetate is preferably used from among these organic solvents.

Process for Preparing Suspension

Next, a suspension is prepared by dispersing the obtained oil phase solution in a water phase solution (process for preparing a suspension).

Then, a reaction is caused between the polyester prepolymer having isocyanate groups and the amine compound along with preparation of the suspension. Then, the urea-modified polyester resin is formed by the reaction. The reaction is accompanied with at least one of a crosslinking reaction and an elongation reaction of a molecular chain. The reaction between the polyester prepolymer having isocyanate groups and the amine compound may be performed with a process for removing a solvent which will be described later.

Here, reaction conditions are selected depending on reactivity between an isocyanate group structure of the polyester prepolymer and the amine compound. In one example, reaction time is preferably from 10 minutes to 40 hours, and preferably from 2 hours to 24 hours. A reaction temperature is preferably from 0° C. to 150° C., and preferably from 40° C. to 98° C. For forming the urea-modified polyester resin, a known catalyst (dibutyltin laurate, dioctyltin laurate, or the like) may be used as needed. That is, a catalyst may be added to the oil phase solution or the suspension.

Examples of the water phase solution include a water phase solution obtained by dispersing a particle dispersant such as a resin particle dispersant or an inorganic particle dispersant in an aqueous solvent. Examples of the water phase solution also include a water phase solution obtained by dispersing a particle dispersant in an aqueous solution and dissolving a polymeric dispersant in an aqueous solution. In addition, a known additive such as a surfactant may be added to the water phase solution.

Examples of the aqueous solution include water (typically, ion exchanged water, distilled water, or pure water, for example). The aqueous solution may be a solvent containing an organic solvent such as alcohol (such as methanol, isopropyl alcohol, or ethylene glycol), dimethylformamide, tetrahydrofuran, cellosolves (such as methyl cellosolve), or lower ketones (such as acetone or methyl ethyl ketone) along with water.

Examples of the organic particle dispersant include a hydrophilic organic particle dispersant. Examples of the organic particle dispersant include particles of poly (meth) acrylic acid alkyl ester resin (such as polymethyl methacrylate), polystyrene resin, and poly (styreneacrylonitrile) resin.

Examples of the inorganic dispersant include a hydrophilic inorganic particle dispersant. Specific examples of the inorganic particle dispersant include particles of silica, alumina, titania, calcium carbonate, magnesium carbonate, tricalcium phosphate, clay, diatomite, or bentonite, and particles of calcium carbonate is preferably used. One kind or two or more kinds of the inorganic particle dispersant may be used alone or in combination.

The surface of the particle dispersant may be treated with polymer having a carboxyl group.

Examples of the polymer having a carboxyl group include copolymer of at least one kind selected from salts (such as alkaline metal salt, alkaline earth metal salt, ammonium salt, and amine salt) obtained by neutralizing α,β-monoethylenic unsaturated carboxylic acid or a carboxyl group in α,β-monoethylenic unsaturated carboxylic acid with alkaline metal, alkaline earth metal, ammonia, amine, or the like and α,β-monoethylenic unsaturated carboxylic acid ester. Examples of the polymer having a carboxylic group also include salts (such as alkaline metal salt, alkaline earth metal salt, ammonium salt, and amine salt) obtained by neutralizing a carboxyl group in copolymer of α,β-monoethylenic unsaturated carboxylic acid and α,β-monoethylenic unsaturated carboxylic acid ester. One kind or two or more kids of the polymer having a carboxylic group may be used alone or in combination.

Representative examples of α,β-monoethylenic unsaturated carboxylic acid include α,β-unsaturated monocarboxylic acid (such as acrylic acid, methacrylic acid, or crotonic acid) and α,β-unsaturated dicarboxylic acid (such as maleic acid, fumaric acid, or itaconic acid). Representative examples of α,β-monoethylenic unsaturated carboxylic acid ester include alkyl esters of (meth) acrylic acid, (meth) acrylate having an alkoxy group, (meth) acrylate having a cyclohexyl group, (meth) acrylate having a hydroxyl group, and polyalkylene glycol mono (meth) acrylate.

Examples of the polymeric dispersant include a hydrophilic polymeric dispersant. Specific examples of the polymeric dispersant include a polymeric dispersant (water soluble cellulose ether such as carboxymethyl cellulose or carboxyethyl cellulose) that has a carboxyl group and does not have a hydrophobic group (such as a hydroxypropoxy group or methoxy group).

Process for Removing Solvent

Next, a toner particle dispersion is obtained by removing the organic solvent from the obtained suspension (process for removing the solvent). The process for removing the solvent is a process of preparing the toner particles by removing the organic solvent contained in liquid droplets of the water phase solution that is dispersed in the suspension. The removal of the organic solvent from the suspension may be performed immediately after the process for preparing the suspension, or may be performed 1 minute or more later than the completion of the process for preparing the suspension.

In the process for removing the solvent, the organic solvent is preferably removed from the suspension by cooling or heating the obtained suspension to a range from 0° C. to 100° C., for example.

As a specific method of removing the organic solvent, the following methods are exemplified.

(1) A method of blowing an air flow to the suspension and forcibly updating a gas phase over the surface of the suspension. In this case, the gas may be blow into the suspension.

(2) A method of decreasing the pressure. In this case, the gas phase over the surface of the suspension may be forcibly updated by filling of the gas, or the gas may be further blown into the suspension.

The toner particles are obtained by the above processes.

Here, toner particles in a dried state after a known cleaning process, a solid-liquid separation process, and a drying process are performed on the toner particles formed in the toner particle dispersion are obtained after the completion of the process for removing the solvent.

In the cleaning process, it is preferable to sufficiently perform replacement cleaning by ion exchanged water in terms of chargeability.

In the solid-liquid separation process, it is preferable to perform suction filtration, pressurizing filtration, or the like in terms of productivity though not particularly limited. In the drying process, it is preferable to perform freeze drying, flash drying, fluidized drying, or vibration-type fluidized drying in terms of productivity though not particularly limited.

The toner according to the exemplary embodiment is manufactured by adding an external additive to the obtained toner particles in the dried state and mixing the toner particles with the external additive, for example.

The mixing is preferably performed by using a V blender, a Henschel mixer, a Loedige mixer, or the like.

Furthermore, coarse particles of the toner may be removed by using a vibration classifier, a wind classifier, or the like as needed.

In the exemplary embodiment, an aggregating and coalescing method by which the shape and the particle diameter of the toner particles may be easily controlled and toner particle structures such as a core shell structure may be controlled in a wide range. Hereinafter, detailed description will be given of a preparing method of the toner particles by the aggregating and coalescing method.

The aggregating and coalescing method according to the exemplary embodiment includes a dispersing process for forming resin particles (emulsified particles) by dispersing raw materials forming the toner particles, an aggregating process for forming an aggregate of the resin particles, and a coalescing process for coalescing the aggregate.

Dispersing Process

The resin particle dispersion may be manufactured by a typical polymerization method such as an emulsion polymerization method, a suspension polymerization method, or a dispersion polymerization method, or may be manufactured by applying a shear stress to a solution obtained by mixing a water medium with a binder resin by a dispersing machine. At this time, the particles may be formed by heating such that the resin component have low viscosity. In addition, a dispersant may be used for stabilizing the dispersed resin particles. As long as the resin is oil-based and dissolved in a solvent with a relatively low solubility with respect to water, the resin particle dispersion is prepared by dissolving the resin in the solvent, dispersing the particles along with a dispersant and a polymer electrolyte in water, and then evaporating the solvent by heating or depressurization.

Examples of the water medium include: water such as distilled water or ion exchanged water; and alcohols, and water is preferably used.

Examples of the dispersant used in the emulsification process include: water soluble polymer such as polyvinyl alcohol, methyl cellulose, ethyl cellulose, hydroxyethyl cellulose, carboxymethyl cellulose, sodium polyacrylate, or sodium polymethacrylate; a surfactant such as an anionic surfactant such as sodium dodecylbenzenesulfonate, sodium octadecyl sulfate, sodium oleate, sodium laurate, or potassium stearate, a cationic surfactant such as laurylamine acetate, stearylamine acetate, or lauryltrimethylammonium chloride, amphoionic surfactant such as lauryldimethylamine oxide, or a nonionic surfactant such as polyoxyethylene alykl ether, polyoxyethylene alkyl phenyl ether, polyoxyethylene alkyl amine; or an inorganic salt such as tricalciium phosphate, aluminum hydroxide, calcium sulfate, or barium carbonate.

Examples of the dispersing machine used in preparing the emulsified solution include a homogenizer, a homomixer, a pressure kneader, an extruder, and a media dispersing machine. As for the size of the resin particles, an average particle diameter (volume average particle diameter) is preferably equal to or less than 1.0 μm, preferably within a range from 60 nm to 300 nm, and further preferably within a range from 150 nm to 250 nm. If the average particle diameter is equal to or greater than 60 nm, there is a case in which the resin particles are easily aggregated since the resin particles tend to be unstable in the dispersion. If the average particle diameter is equal to or less than 1.0 μm, there is a case in which particle diameter distribution of the toner becomes narrow.

For preparing the release agent dispersion, a release agent is dispersed along with an ionic surfactant and a polymer electrolyte such as polymeric acid or polymeric base in water, the resulting object is heated at a temperature of equal to or greater than a melting temperature of the release agent, and dispersion processing is performed by using a homogenizer or a pressure ejection-type dispersing machine that applies high shear force. By such processing, the release agent dispersion is obtained. In the dispersion processing, an inorganic compound such as polyaluminum chloride may be added to the dispersion. Examples of a preferable inorganic compound include polyaluminum chloride, aluminum sulfate, highly basic polyaluminum chloride (BAC), polyaluminum hydroxide, and aluminum chloride. Among these examples, polyaluminum chloride, aluminum sulfate, and the like are preferably used.

By the dispersion processing, a release agent dispersion containing release agent particles with a volume average particle diameter of equal to or less than 1 μm is obtained.

The volume average particle diameter of the release agent particles is more preferably from 100 nm to 500 nm.

If the volume average particle diameter is equal to or greater than 100 nm, the release agent component is easily taken into the toner in general, which is affected by properties of the binder resin used. If the volume average particle diameter is equal to or less than 500 nm, a satisfactory dispersing state of the release agent in the toner is achieved.

For preparing the brilliant pigment dispersion, it is possible to use a known dispersing method and to use a typical dispersing unit such as a rotation shear-type homogenizer, a ball mill provided with a medium, a sand mill, a dynomill, or an ultimizer, and there is no limitation. The brilliant pigment is dispersed along with the ionic surfactant and the polymer electrolyte such as polymeric acid or polymeric base in water. The volume average particle diameter of the dispersed brilliant pigment is allowable as long as the size is equal to or less than 20 μm. However, the volume average particle diameter within the range from 3 μm to 16 μm is preferable since the volume average particle diameter does not damage an aggregating property and satisfactory dispersion of the brilliant pigment in the toner may be achieved.

The dispersion of the brilliant pigment covered with the binder resin may be prepared by dispersing or dissolving and mixing the brilliant pigment and the binder resin in the solvent and dispersing the resulting object in water by phase transfer emulsification or shear emulsification.

Aggregating Process

In the aggregating process, a mixed solution is obtained by mixing the resin particle dispersion, the brilliant pigment dispersion, the release agent dispersion, and the like, the mixed solution is heated at a temperature of equal to or less than a glass transition temperature of the resin particles to cause aggregation, and aggregated particles are formed. The aggregated particles are formed by controlling pH of the mixed solution to be acidic while stirred, in many cases. It becomes possible to set the ratio (C/D) within the preferable range under the stirring conditions. More specifically, it becomes possible to reduce the ratio (C/D) by stirring the mixed solution at a high speed and heating the mixed solution in a stage of forming the aggregated particles, and to increase the ratio (C/D) by stirring the mixed solution at a lower speed at a lower temperature. In addition, pH is preferably within the range from 2 to 7, and it is also effective to use an aggregating agent at this time.

In the aggregating process, the release agent dispersion may be added and mixed at one time along with various dispersions such as the resin particle dispersion, or may be divided and added multiple times.

As the aggregating agent, a surfactant with opposite polarity to that of the surfactant used in the dispersant, an inorganic metal salt, and a bivalent or more metal complex are preferably used. Use of the metal complex is particularly preferable since the amount of surfactant used may be reduced and a charging property is enhanced.

As the inorganic metal salt, aluminum salt and polymer thereof are preferably used in particular. As for the valence of the inorganic metal salt, a divalent inorganic metal salt is more suitable than a monovalent inorganic metal salt, a trivalent inorganic metal salt is more suitable than the divalent inorganic metal salt, and tetravalent inorganic metal salt is more suitable than the trivalent inorganic metal salt, and in a case of the same valence, a polymerization-type inorganic metal salt polymer is more suitable in order to obtain narrower particle diameter distribution.

In the exemplary embodiment, it is preferable to use polymer of tetravalent inorganic metal salt containing aluminum in order to obtain narrow particle diameter distribution.

The toner with a configuration in which surfaces of the core aggregated particles are covered with the resin may be prepared by additionally adding the resin particle dispersion when a desired particle diameter of the aggregated particles is obtained (covering process). The configuration in this case is preferable in terms of chargeability and a developing property since the release agent and the brilliant pigment are not easily exposed to the surface of the toner. In the case of additionally adding the resin particle dispersion, an aggregating agent may be added or pH adjustment may be performed before the additional addition.

Coalescing Process

In the coalescing process, the aggregated particles are coalesced by stopping advancing of the aggregation by increasing pH of the aggregated particle suspension to a range from 3 to 9 in the stirring conditions in the aforementioned aggregating process and performing heating at the temperature of equal to or greater than the glass transition temperature of the resin.

In the case of covering the core, aggregated particles, with the resin, the resin is also coalesced to cover the core, aggregated particles. Any heating time is allowable as long as the coalescence may be achieved, and the coalescence may be performed for a period of time from about 0.5 hours to about 10 hours.

The resulting object is cooled after the coalescence, and coalesced particles are obtained. In the process of cooling, crystallization may be promoted by reducing a cooling rate in the vicinity of the glass transition temperature of the resin (within the range of glass transition temperature ±10° C.), that is, by performing slow cooling.

A solid-liquid separation process such as filtration, and if necessary, a cleaning process and a drying process are performed on the coalesced particles obtained by the coalescence, and toner particles are thus obtained.

In organic oxides and the like, representative examples of which include silica, titania, and aluminum oxide, are added and attached to the obtained toner particles as external additives for the purpose of charge adjustment, application of fluidity, application of a charge exchange property, and the like. A preferable externally adding method and a preferable amount of the external additives added are as described above.

In addition to the aforementioned inorganic oxides and the like, other components (particles) such as a charge-controlling agent, an organic particle, a lubricant, and an abrasive may be added as external additives.

Although the charge-controlling agent is not particularly limited, colorless or light-color charge-controlling agent is preferably used. Examples thereof include complexes of a quaternary ammonium salt compound, a nigrosine compound, aluminum, or chromium, and a triphenylmethane pigment.

Examples of the organic particles include particles, which are typically used as an external additive added to the toner surfaces, of vinyl resin, polyester resin, or silicone resin. The inorganic particles and the organic particles are used as a fluidity aid, a cleaning aid, and the like.

Examples of the lubricant include fatty acid amide such as ethylenebisstearic acid amide, or oleic acid amide and fatty acid metal salt such as zinc stearate or calcium stearate.

Examples of the abrasive include silica, alumina, and cerium oxide.

Electrostatic Charge Image Developer

The electrostatic charge image developer according to the exemplary embodiment contains at least the toner according to the exemplary embodiment.

The electrostatic charge image developer according to the exemplary embodiment may be single-component developer that contains only the toner according to the exemplary embodiment or may be a two-component developer in which the toner is mixed with a carrier.

The carrier is not particularly limited, and known carriers are exemplified. Examples of the carrier include a covered carrier in which the surfaces of cores made of magnetic particles are covered with resin; a magnetic particle dispersed-type carrier in which magnetic particles are dispersed and blended in matrix resin; and resin impregnation-type carrier in which resin is impregnated in porous magnetic particles.

The magnetic particle dispersed-type carrier and the resin impregnation-type carrier may be carrier in which constituent particles of the carriers form cores and the surfaces thereof are covered with resin.

Examples of the magnetic particles include: magnetic metal such as iron, nickel, or cobalt; and magnetic oxide such as ferrite and magnetite.

Examples of the resin for covering and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene acrylic acid copolymer, or straight silicone resin or modified substances thereof that contain a organosiloxane bond, fluorine resin, polyester, polycarbonate, phenol resin, and epoxy resin. The resin for covering and the matrix resin may contain an additive such as conductive particles.

Examples of the conductive particles include: metal such as gold, silver, or copper; and particles of carbon black, titanium oxide, zinc oxide, tin oxide, barium sulfate, aluminum borate, potassium titanate, or the like.

For covering the surfaces of the cores, a covering method using a solution for forming a covering layer that is obtained by dissolving the resin for covering and various additives (used as needed) in an appropriate solvent is exemplified. The solvent is not particularly limited and may be selected in consideration of the type of the resin used, application aptitudes, and the like. Specific examples of the resin covering method include: a dipping method of dipping the cores in the solution for forming the covering layer; a spray method of spraying the solution for forming the covering layer to the surfaces of the cores; a fluidized bed method of spraying the solution for forming the covering layer in a state in which the cores are made to float by air flow; and a kneader coater method of mixing the cores of the carrier and the solution for forming the covering layer in a kneader coater and then removing a solvent.

A mixing ratio (weight ratio) between the toner and the carrier in the two-component developer is preferably from toner:carrier=1:100 to 30:100, and more preferably from 3:100 to 20:100.

Image Forming Apparatus/Image Forming Method

Description will be given of an image forming apparatus and an image forming method according to the exemplary embodiment.

The image forming apparatus according to the exemplary embodiment includes an image holding member, a charging unit that charges a surface of the image holding member, an electrostatic charge image forming unit that forms an electrostatic charge image on the charged surface of the image holding member, a developing unit that accommodates an electrostatic charge image developer and develops the electrostatic charge image formed on the surface of the image holding member as a toner image by the electrostatic charge image developer, a transfer unit that transfers the toner image formed on the surface of the image holding member to a surface of a recording medium, and a fixing unit that fixes the toner image transferred to the surface of the recording medium.

The electrostatic charge image developer according to the exemplary embodiment is applied as the electrostatic charge image developer.

The image forming apparatus according to the exemplary embodiment performs the image forming method (the image forming method according to the exemplary embodiment) including a charging process of charging the surface of the image holding member, an electrostatic charge image formation process of forming the electrostatic charge image on the charged surface of the image holding member, a developing process of developing the electrostatic charge image formed on the surface of the image holding member as the toner image by the electrostatic charge image developer according to the exemplary embodiment, a transfer process of transferring the toner image formed on the surface of the image holding member to the surface of the recording medium, and a fixing process of fixing the toner image transferred to the surface of the recording medium.

As the image forming apparatus according to the exemplary embodiment, a known image forming apparatus such as: a direct transfer-type apparatus that directly transfers the toner image formed on the surface of the image holding member to the recording medium; an intermediate transfer-type apparatus that primarily transfers the toner image formed on the surface of the image holding member to a surface of an intermediate transfer member and secondarily transfers the toner image transferred to the surface of the intermediate transfer member to the surface of the recording medium; an apparatus provided with a cleaning unit that cleans the surface of the image holding member before the charging and after the transferring of the toner image; or an apparatus provided with a charge eliminating unit that eliminates the charge by irradiating the surface of the image holding member with charge eliminating light before the charging and after the transferring of the toner image is applied.

In a case of the intermediate transfer-type apparatus, a structure including an intermediate transfer member with a surface to which the toner image is transferred, a primary transfer unit that primarily transfers the toner image formed on the surface of the image holding member to the surface of the intermediate transfer member, and a secondary transfer unit that secondarily transfers the toner image transferred to the surface of the intermediate transfer member to the surface of the recording medium, for example, is applied.

In the image forming apparatus according to the exemplary embodiment, a portion including the developing unit, for example, may have a cartridge structure (process cartridge) that is detachable from the image forming apparatus. As the process cartridge, a process cartridge that accommodates the electrostatic charge image developer according to the exemplary embodiment and is provided with the developing unit is preferably used.

Hereinafter, description will be given of an example of the image forming apparatus according to the exemplary embodiment. However, the image forming apparatus is not limited thereto. Main components illustrated in the drawings will be described, and descriptions of the other components will be omitted.

Figure 2:
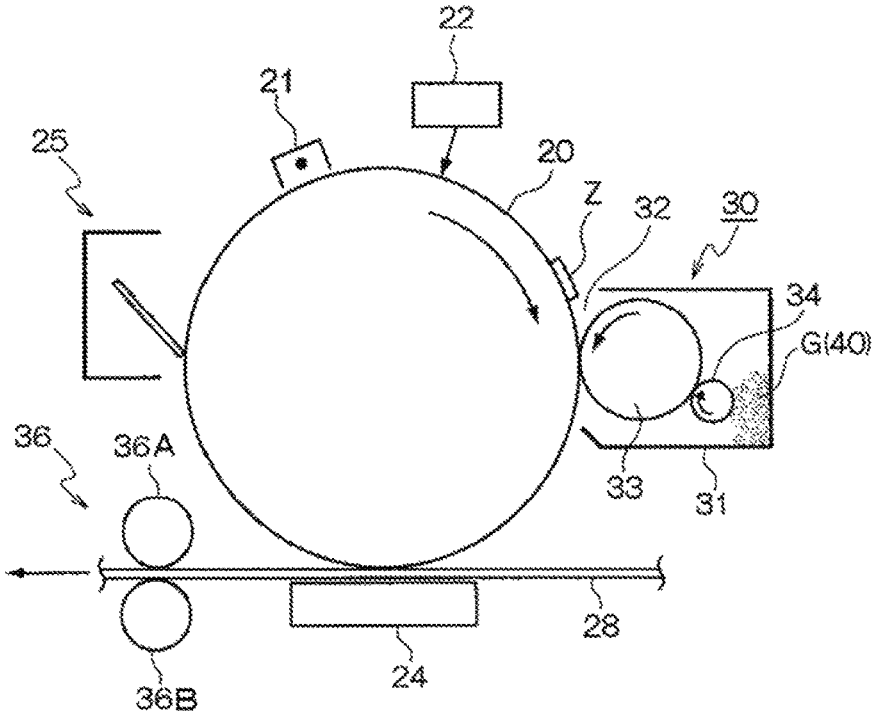
FIG. 2 is a configuration diagram schematically illustrating an exemplary image forming apparatus according to an exemplary embodiment.

FIG. 2 is a configuration diagram schematically illustrating an exemplary embodiment of an image forming apparatus that includes a developing device to which the electrostatic charge image developer according to the exemplary embodiment is applied.

In the drawing, the image forming apparatus according to the exemplary embodiment includes a photosensitive drum 20 as the image holding member that rotates in a predetermined direction. In the periphery of the photosensitive drum 20, a charging device 21 that charges the photosensitive drum 20, an exposure device 22, for example, as the electrostatic charge image forming device that forms an electrostatic charge image Z on the photosensitive drum 20, a developing device 30 that develops the electrostatic charge image Z formed on the photosensitive drum 20 as a visible image, a transfer device 24 that transfers the toner image visualized on the photosensitive drum 20 to a recording sheet 28 as the recording medium, and a cleaning device 25 that cleans toner remaining on the photosensitive drum 20 are disposed in order.

In the exemplary embodiment, the developing apparatus 30 includes a developing housing 31 that accommodates a developer G containing a toner 40 as illustrated in FIG. 2. A developing opening 32 opens in the developing housing 31 so as to face the photosensitive drum 20. A developing roller (developing electrode) 33 as a toner holding member is disposed so as to face the developing opening 32. By applying a predetermined developing bias to the developing roller 33, a developing electric field is formed in a region (developing region) interposed between the photosensitive drum 20 and the developing roller 33. Furthermore, a charge injection roller (injection electrode) 34 as a charge injecting member is provided in the developing housing 31 so as to face the developing roller 33. In particular, the charge injection roller 34 also serves as a toner supply roller for supplying the toner 40 to the developing roller 33 in the exemplary embodiment.

Here, a rotation direction of the charge injection roller 34 may be selected. However, the charge injection roller 34 preferably rotates in the same direction as that of the developing roller 33 at the facing portion with a difference in the peripheral speeds (1.5 times or higher, for example), interpose the toner 40 in the region between the charge injection roller 34 and the developing roller 33, and injects the charge while scraping, in consideration of a toner supply property and a charge injection property.

Next, description will be given of operations of the image forming apparatus according to the exemplary embodiment.

If an image creating process is started, the charging device 21 charges the surface of the photosensitive drum 20 first, the exposure device 22 writes the electrostatic charge image Z on the charged photosensitive drum 20, and the developing device 30 develops the electrostatic charge image Z as a toner image that is a visible image. Thereafter, the toner image on the photosensitive drum 20 is transported to the transfer portion, and the transfer device 24 electrostatically transfers the toner image on the photosensitive drum 20 to the recording sheet 28 as the recording medium. The cleaning device 25 cleans the toner remaining on the photosensitive drum 20. Thereafter, the fixing device 36 provided with a fixing member 36A (a fixing belt, a fixing roller, and the like) and a pressurizing member 36B fixes the toner image on the recording sheet 28, and an image is obtained.

Process Cartridge/Toner Cartridge

Description will be given of the process cartridge according to the exemplary embodiment.

The process cartridge according to the exemplary embodiment is a process cartridge that includes a developing unit accommodating the electrostatic charge image developer according to the exemplary embodiment and develops the electrostatic charge image formed on the surface of the image holding member as a toner image by the electrostatic charge image developer and that is detachable from the image forming apparatus.

The process cartridge according to the exemplary embodiment is not limited to the aforementioned configuration and may have a configuration that includes a developing apparatus, and if necessary, at least one selected from other units such as an image holding member, a charging unit, an electrostatic charge image forming unit, and a transfer unit.

Although an example of the process cartridge according to the exemplary embodiment will be described below, the process cartridge is not limited thereto. In addition, main components illustrated in the drawings will be described, and descriptions of the other components will be omitted.

Figure 3:
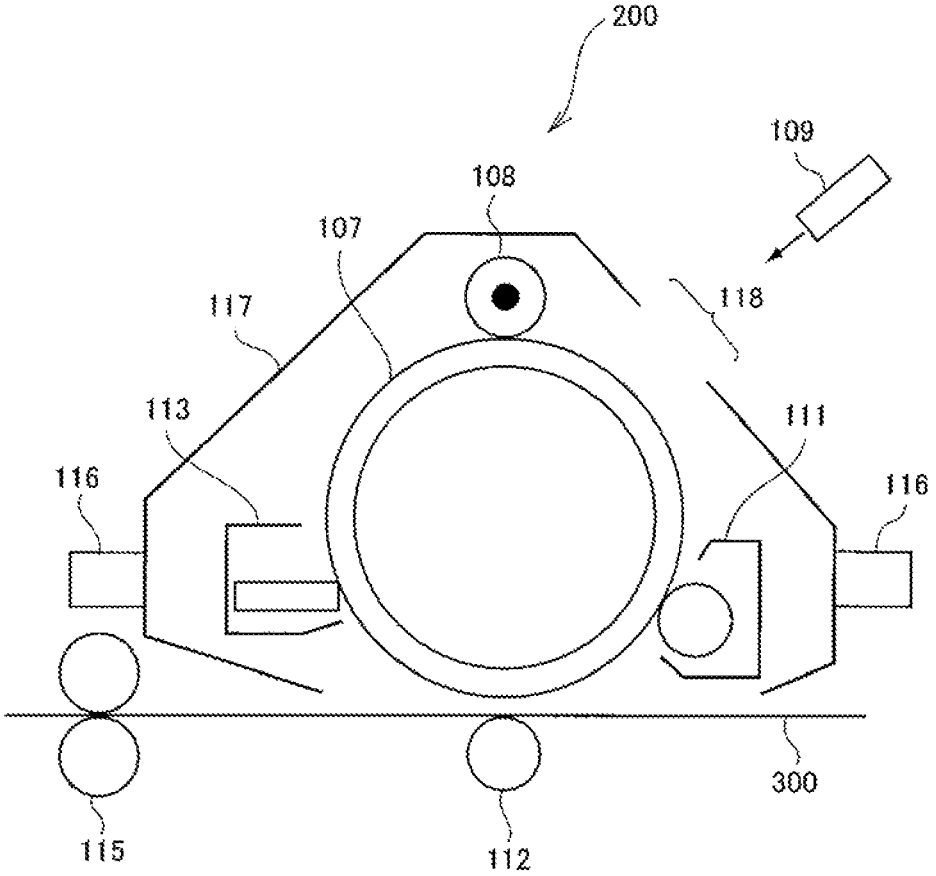
FIG. 3 is a configuration diagram schematically illustrating an exemplary process cartridge according to an exemplary embodiment.

FIG. 3 is a configuration diagram schematically illustrating the process cartridge according to the exemplary embodiment.

The process cartridge 200 illustrated in FIG. 3 integrally combines and holds a photoreceptor 107 (an example of the image holding member), a charging roller 108 (an example of the charging unit) provided in the periphery of the photoreceptor 107, a developing device 111 (an example of the developing unit), and a photoreceptor cleaning device 113 (an example of the cleaning unit) in a housing 117 provided with an attachment rail 116 and an opening 118 for exposure, for example, and is provide as a cartridge.

In FIG. 3, 109 represents an exposure device (an example of the electrostatic charge image forming unit), 112 represents a transfer device (an example of the transfer unit), 115 represents a fixing device (an example of the fixing unit), and 300 represents a recording sheet (an example of the recording medium).

Next, description will be given of a toner cartridge according to the exemplary embodiment.

The toner cartridge according to the exemplary embodiment may accommodate the toner according to the exemplary embodiment and may be detachable from the image forming apparatus. It is only necessary for the toner cartridge according to the exemplary embodiment to accommodate at least the toner, and the developer, for example, may be accommodated therein depending on a mechanism of the image forming apparatus.

The image forming apparatus illustrated in FIG. 2 is an image forming apparatus with a configuration in which the toner cartridge (not shown) may be freely attached to and detached from, and the developing device 30 is connected to the toner cartridge with a toner supply tube which is not shown in the drawing. In a case in which the amount of toner accommodated in the toner cartridge becomes small, the toner cartridge may be replaced.

EXAMPLES

Although detailed description will be given below of the exemplary embodiment with reference to examples, the exemplary embodiment is not limited to these examples. In the following description, all the descriptions of "parts" and "%" are on a weight basis unless otherwise indicated.

Preparation of Unmodified Polyester Resin (1)

Terephthalic acid: 1243 parts

Ethylene oxide adduct of bisphenol A: 1830 parts

Propylene oxide adduct of bisphenol A: 840 parts

The above components are mixed while heated at 180° C., 3 parts of dibutyltin oxide is then added thereto, water is evaporated while the mixture is heated at 220°, and unsaturated polyester resin is obtained. The glass transition temperature Tg of the obtained unsaturated polyester resin is 60° C., the acid value is 3 mgKOH/g, and the hydroxyl group value is 1 mgKOH/g.

Preparation of Polyester Prepolymer (1)

Terephthalic acid: 1243 parts

Ethylene oxide adduct of bisphenol A: 1830 parts

Propylene oxide adduct of bisphenol A: 840 parts

The above components are mixed while heated at 180° C., 3 parts of dibutyltin oxide is then added thereto, water is evaporated while the mixture is heated at 220° C., and polyester is obtained. 350 parts of the obtained polyester, 50 parts of tolylene diisocyanate, and 450 pars of ethyl acetate are poured into a container, the mixture thereof is heated at 130° C. for 3 hours, and polyester prepolymer (1) having isocyanate groups (hereinafter, referred to as isocyanate-modified polyester prepolymer (1)) is obtained.

Preparation of Ketimine Compound (1)

50 parts of methyl ethyl ketone and 150 parts of hexamethylenediamine are poured into a container, the mixture thereof is stirred at 60° C., and a ketimine compound (1) is obtained.

Preparation of Brilliant Pigment Dispersion (1)

Atomized powder of aluminum with an average particle diameter of 4 μm: 100 parts Mineral spirits: 120 parts Stearic acid: 3 parts The above components are mixed and ground by a ball mill for 15 hours, and brilliant pigment (1) is obtained.

Brilliant pigment (1): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (1) (solid component concentration: 10%) with the brilliant pigment (1) dispersed therein is obtained. The average thickness, the volume average particle diameter, the upper GSD of the average thickness, the lower GSD of the average thickness, and the aspect ratio of the brilliant pigment contained in the brilliant pigment dispersion (1) will be shown in Table 1. Preparation of brilliant pigment dispersion (2)

Atomized powder of aluminum with an average particle diameter of 3.5 μm: 100 parts Mineral spirits: 120 parts Stearic acid: 3 parts The above components are mixed and ground by a ball mill for 15 hours, and brilliant pigment (2) is obtained.

Brilliant pigment (2): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (2) (solid component concentration: 10%) with the brilliant pigment (2) dispersed therein is obtained. The average thickness, the volume average particle diameter, the upper GSD of the average thickness, the lower GSD of the average thickness, and the aspect ratio of the brilliant pigment contained in the brilliant pigment dispersion (2) will be shown in Table 1.

Preparation of Brilliant Pigment Dispersion (3)

Atomized powder of aluminum with an average particle diameter of 5 μm: 100 parts Mineral spirits: 120 parts Stearic acid: 3 parts The above components are mixed and ground by a ball mill for 15 hours, and brilliant pigment (3) is obtained.

Brilliant pigment (3): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (3) (solid component concentration: 10%) with the brilliant pigment (3) dispersed therein is obtained. The average thickness, the volume average particle diameter, the upper GSD of the average thickness, the lower GSD of the average thickness, and the aspect ratio of the brilliant pigment contained in the brilliant pigment dispersion (3) will be shown in Table 1. Preparation of brilliant pigment dispersion (4)

Atomized powder of aluminum with an average particle diameter of 3.5 μm: 100 parts Mineral spirits: 120 parts Stearic acid: 3 parts The above components are mixed and ground by a ball mill for 20 hours, and brilliant pigment (4) is obtained.

Brilliant pigment (4): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (4) (solid component concentration: 10%) with the brilliant pigment (4) dispersed therein is obtained. The average thickness, the volume average particle diameter, the upper GSD of the average thickness, the lower GSD of the average thickness, and the aspect ratio of the brilliant pigment contained in the brilliant pigment dispersion (4) will be shown in Table 1. Preparation of brilliant pigment dispersion (5)

Atomized powder of aluminum with an average particle diameter of 5.5 μm: 100 parts Mineral spirits: 120 parts Stearic acid: 3 parts The above components are mixed and ground by a ball mill for 15 hours, and brilliant pigment (5) is obtained.

Brilliant pigment (5): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (5) (solid component concentration: 10%) with the brilliant pigment (5) dispersed therein is obtained. The average thickness, the volume average particle diameter, the upper GSD of the average thickness, the lower GSD of the average thickness, and the aspect ratio of the brilliant pigment contained in the brilliant pigment dispersion (5) will be shown in Table 1.

Preparation of Brilliant Pigment Dispersion (6)

Pearl pigment (flake-shaped brilliant pigment IRIODIN 121 manufactured by Merck & Co., Inc.): 100 parts Ethyl acetate: 500 parts The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (6) (solid component concentration: 10%) with the pearl pigment dispersed therein is obtained. The average thickness, the volume average particle diameter, the upper GSD of the average thickness, the lower GSD of the average thickness, and the aspect ratio of the brilliant pigment contained in the brilliant pigment dispersion (6) will be shown in Table 1.

Preparation of Brilliant Pigment Dispersion (7)

Atomized powder of aluminum with an average particle diameter of 2 μm: 100 parts Mineral spirits: 120 parts Stearic acid: 3 parts The above components are mixed and ground by a ball mill for 15 hors, and brilliant pigment (7) is obtained.

Brilliant pigment (7): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (7) (solid component concentration: 10%) with the brilliant pigment (7) dispersed therein is obtained. The average thickness, the volume average particle diameter, the upper GSD of the average thickness, the lower GSD of the average thickness, and the aspect ratio of the brilliant pigment contained in the brilliant pigment dispersion (7) will be shown in Table 1.

Preparation of Brilliant Pigment Dispersion (8)

Atomized powder of aluminum with an average particle diameter of 9 μm: 100 parts Mineral spirits: 120 parts Stearic acid: 3 parts The above components are mixed and ground by a ball mill for 20 hours, and brilliant pigment (8) is obtained.

Brilliant pigment (8): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (8) (solid component concentration: 10%) with the brilliant pigment (8) dispersed therein is obtained. The average thickness, the volume average particle diameter, the upper GSD of the average thickness, the lower GSD of the average thickness, and the aspect ratio of the brilliant pigment contained in the brilliant pigment dispersion (8) will be shown in Table 1. Preparation of brilliant pigment dispersion (9)

Atomized powder of aluminum with an average particle diameter of 4 μm: 100 parts Mineral spirits: 120 parts Stearic acid: 3 parts The above components are mixed and ground by a ball mill for 10 hours (a). 170 parts of the mixture is extracted and further ground for five hours by the ball mill (b). (a) and (b) are mixed, and brilliant pigment (9) is obtained.

Brilliant pigment (9): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (9) (solid component concentration: 10%) with the brilliant pigment (9) dispersed therein is obtained. The average thickness, the volume average particle diameter, the upper GSD of the average thickness, the lower GSD of the average thickness, and the aspect ratio of the brilliant pigment contained in the brilliant pigment dispersion (9) will be shown in Table 1.

Preparation of Brilliant Pigment Dispersion (10)

Atomized powder of aluminum with an average particle diameter of 4 μm: 100 parts Mineral spirits: 120 parts Stearic acid: 3 parts The above components are mixed and ground by a ball mill for 15 hours (c). 55 parts of the mixture is extracted and further ground for five hours by the ball mill (d). (c) and (d) are mixed, and brilliant pigment (10) is obtained.

Brilliant pigment (10): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (10) (solid component concentration: 10%) with the brilliant pigment (10) dispersed therein is obtained. The average thickness, the volume average particle diameter, the upper GSD of the average thickness, the lower GSD of the average thickness, and the aspect ratio of the brilliant pigment contained in the brilliant pigment dispersion (10) will be shown in Table 1.

Preparation of Brilliant Pigment Dispersion (11)

Atomized powder of aluminum with an average particle diameter of 2.5 μm: 100 parts Mineral spirits: 120 parts Stearic acid: 3 parts The above components are mixed and ground by a ball mill for 10 hours, and brilliant pigment (11) is obtained.

Brilliant pigment (11): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (11) (solid component concentration: 10%) with the brilliant pigment (11) dispersed therein is obtained. The average thickness, the volume average particle diameter, the upper GSD of the average thickness, the lower GSD of the average thickness, and the aspect ratio of the brilliant pigment contained in the brilliant pigment dispersion (11) will be shown in Table 1.

Preparation of Brilliant Pigment Dispersion (12)

Atomized powder of aluminum with an average particle diameter of 8.5 μm: 100 parts Mineral spirits: 120 parts Stearic acid: 3 parts The above components are mixed and ground by a ball mill for 25 hours, and brilliant pigment (12) is obtained.

Brilliant pigment (12): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (12) (solid component concentration: 10%) with the brilliant pigment (12) dispersed therein is obtained. The average thickness, the volume average particle diameter, the upper GSD of the average thickness, the lower GSD of the average thickness, and the aspect ratio of the brilliant pigment contained in the brilliant pigment dispersion (12) will be shown in Table 1. Preparation of brilliant pigment dispersion (13)

Atomized powder of aluminum with an average particle diameter of 10 μm: 100 parts Mineral spirits: 120 parts Stearic acid: 3 parts The above components are mixed and ground by a ball mill for 25 hours, and brilliant pigment (13) is obtained.

Brilliant pigment (13): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (13) (solid component concentration: 10%) with the brilliant pigment (13) dispersed therein is obtained. The average thickness, the volume average particle diameter, the upper GSD of the average thickness, the lower GSD of the average thickness, and the aspect ratio of the brilliant pigment contained in the brilliant pigment dispersion (13) will be shown in Table 1.

Preparation of Brilliant Pigment Dispersion (14)

Atomized powder of aluminum with an average particle diameter of 2.5 μm: 100 parts Mineral spirits: 120 parts Stearic acid: 3 parts The above components are mixed and ground by a ball mill for 8 hours, and brilliant pigment (14) is obtained.

Brilliant pigment (14): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser Cavitron (CR1010 manufactured by Pacific Machinery & ENGINEERING Co. Ltd.), and a brilliant pigment dispersion (14) (solid component concentration: 10%) with the brilliant pigment (14) dispersed therein is obtained. The average thickness, the volume average particle diameter, the upper GSD of the average thickness, the lower GSD of the average thickness, and the aspect ratio of the brilliant pigment contained in the brilliant pigment dispersion (14) will be shown in Table 1.

Preparation of Brilliant Pigment Dispersion (15)

Atomized powder of aluminum with an average particle diameter of 8.5 μm: 100 parts Mineral spirits: 120 parts Stearic acid: 3 parts The above components are mixed and ground by a ball mill for 28 hours, and brilliant pigment (15) is obtained.

Brilliant pigment (15): 100 parts

Ethyl acetate: 500 parts

The above components are mixed, an operation of filtrating the mixture and further mixing the mixture with 500 parts of ethyl acetate is repeated five times, the mixture is then dispersed for 1 hour by using an emulsification disperser CAVITRON (CR1010 manufactured by Pacific Machinery & Engineering Co., Ltd.), and a brilliant pigment dispersion (15) (solid component concentration: 10%) with the brilliant pigment (15) dispersed therein is obtained. The average thickness, the volume average particle diameter, the upper GSD of the average thickness, the lower GSD of the average thickness, and the aspect ratio of the brilliant pigment contained in the Brilliant pigment dispersion (15) will be shown in Table 1.

Preparation of Release Agent Dispersion (1)

Paraffin wax (melting temperature: 89° C.): 30 parts

Ethyl acetate: 270 parts

The above components are wet-pulverized by a micro beads disperser (DCP mill) in a state of being cooled at 10° C., and a release agent dispersion (1) is obtained.

Preparation of Oil Phase Solution (1)

Unmodified polyester resin (1): 136 parts

Brilliant pigment dispersion (1): 500 parts

Ethyl acetate: 56 parts

The above components are stirred and mixed, 75 parts of release agent dispersion (1) is then added to the obtained mixture, the mixture is stirred, and an oil phase solution (1) is obtained.

Preparation of Styrene Acrylic Resin Particle Dispersion (1)

Styrene: 370 parts n-Butyl acrylate: 30 parts

Acrylic acid: 4 parts

Dodecanethiol: 24 parts

Carbon tetrabromide: 4 parts

A mixture obtained by mixing and dissolving the above components are emulsified in an aqueous solution, which is obtained by dissolving 6 parts of nonionic surfactant (NONIPOL 400 manufactured by Sanyo Chemical Industries, Ltd.) and 10 parts of anionic surfactant (NEOGEN SC manufactured by DSK Co., Ltd.) in 560 parts of ion exchanged water, in a flask, an aqueous solution obtained by dissolving 4 parts of ammonium persulfate in 50 parts of ion exchanged water is poured into the mixture while the mixture is mixed for 10 minutes, the mixture is subjected to nitrogen purge and is then heated in an oil bath until the temperature of the content reaches 70° C. while the content in the flask is stirred, and emulsification polymerization is continued as it is for 5 hours. Thus, a styrene acrylic resin particle dispersion (1) (resin particle concentration: 40%) in which resin particles with an average particle diameter of 180 nm and a weight average molecular weight (Mw) is 15,500 are dispersed is obtained. The glass transition temperature of the styrene acrylic resin particles is 59° C.

Preparation of Water Phase Solution (1)

Styrene acrylic resin particle dispersion (1): 60 parts

2% aqueous solution of Celogen BS-H (DSK Co., Ltd.): 200 parts

Ion exchanged water: 200 parts

The above components are stirred and mixed, and a water phase solution (1) is obtained.

Example 1

Preparation of Toner Particles (1)

Oil phase solution (1): 300 parts

Isocyanate-modified polyester prepolymer (1): 25 parts

Ketimine compound (1): 0.5 parts

The above components are put into a container, an oil phase solution (1P) is obtained by stirring the components for 2 minutes by a homogenizer (ULTRA-TURRAX manufactured by IKA), 1000 parts of the water phase solution (1) is then added to the container, and the mixture is stirred for 20 minutes by the homogenizer. Then, the mixture solution is stirred at room temperature (25° C.) at an ordinary pressure (1 atm) for 48 hours by a propeller-type stirrer, urea-modified polyester resin is formed by causing a reaction between the isocyanate-modified polyester prepolymer (1) and the ketimine compound (1), an organic solvent is removed, and grains are obtained. Then, the grains are washed with water, dried, and classified, and the toner particles (1) are obtained. The volume average particle diameter of the toner particles is 12.0 μm, and the aspect ratio is 6.0.

Preparation of Brilliant Toner (1)

100 parts of toner particles (1), 1.5 parts of hydrophobic silica (RY50 manufactured by Nippon Aerosil Co., Ltd.), and 1.0 part of hydrophobic titanium oxide (T805 manufactured by Nippon Aerosil Co., Ltd.) are mixed at 10000 rpm for 30 seconds by a sample mill. Thereafter, the mixture is classified by a vibration classifier with a mesh of 45 μm, and a brilliant toner (1) is obtained.

Example 2

The oil phase solution (2) is obtained in the same manner as the oil phase solution (1) other than that the brilliant pigment dispersion (2) is used instead of the brilliant pigment dispersion (1) in the preparation of the oil phase solution (1).

In addition, the brilliant toner (2) is obtained in the same manner as the brilliant toner (1) other than that the oil phase solution (2) is used.

Example 3

The oil phase solution (3) is obtained in the same manner as the oil phase solution (1) other than that the brilliant pigment dispersion (3) is used instead of the brilliant pigment dispersion (1) in the preparation of the oil phase solution (1).

In addition, the brilliant toner (3) is obtained in the same manner as the brilliant toner (1) other than that the oil phase solution (3) is used.

Comparative Example 1

The oil phase solution (4) is obtained in the same manner as the oil phase solution (1) other than that the brilliant pigment dispersion (4) is used instead of the brilliant pigment dispersion (1) in the preparation of the oil phase solution (1).

In addition, the brilliant toner (4) is obtained in the same manner as the brilliant toner (1) other than that the oil phase solution (4) is used.

Comparative Example 2

The oil phase solution (5) is obtained in the same manner as the oil phase solution (1) other than that the brilliant pigment dispersion (5) is used instead of the brilliant pigment dispersion (1) in the preparation of the oil phase solution (1).

In addition, the brilliant toner (5) is obtained in the same manner as the brilliant toner (1) other than that the oil phase solution (5) is used.

Example 4

The oil phase solution (6) is obtained in the same manner as the oil phase solution (1) other than that the brilliant pigment dispersion (6) is used instead of the brilliant pigment dispersion (1) in the preparation of the oil phase solution (1).

In addition, the brilliant toner (6) is obtained in the same manner as the brilliant toner (1) other than that the oil phase solution (6) is used.

Example 5

The oil phase solution (7) is obtained in the same manner as the oil phase solution (1) other than that the brilliant pigment dispersion (7) is used instead of the brilliant pigment dispersion (1) in the preparation of the oil phase solution (1).

In addition, the brilliant toner (7) is obtained in the same manner as the brilliant toner (1) other than that the oil phase solution (7) is used.

Example 6

The oil phase solution (8) is obtained in the same manner as the oil phase solution (1) other than that the brilliant pigment dispersion (8) is used instead of the brilliant pigment dispersion (1) in the preparation of the oil phase solution (1).

In addition, the brilliant toner (8) is obtained in the same manner as the brilliant toner (1) other than that the oil phase solution (8) is used.

Example 7

The oil phase solution (9) is obtained in the same manner as the oil phase solution (1) other than that the brilliant pigment dispersion (9) is used instead of the brilliant pigment dispersion (1) in the preparation of the oil phase solution (1).

In addition, the brilliant toner (9) is obtained in the same manner as the brilliant toner (1) other than that the oil phase solution (9) is used.

Example 8

The oil phase solution (10) is obtained in the same manner as the oil phase solution (1) other than that the brilliant pigment dispersion (10) is used instead of the brilliant pigment dispersion (1) in the preparation of the oil phase solution (1).

In addition, the brilliant toner (10) is obtained in the same manner as the brilliant toner (1) other than that the oil phase solution (10) is used.

Example 9

The oil phase solution (11) is obtained in the same manner as the oil phase solution (1) other than that the brilliant pigment dispersion (11) is used instead of the brilliant pigment dispersion (1) in the preparation of the oil phase solution (1).

In addition, the brilliant toner (11) is obtained in the same manner as the brilliant toner (1) other than that the oil phase solution (11) is used.

Example 10

The oil phase solution (12) is obtained in the same manner as the oil phase solution (1) other than that the brilliant pigment dispersion (12) is used instead of the brilliant pigment dispersion (1) in the preparation of the oil phase solution (1).

In addition, the brilliant toner (12) is obtained in the same manner as the brilliant toner (1) other than that the oil phase solution (12) is used.

Example 11

The oil phase solution (13) is obtained in the same manner as the oil phase solution (1) other than that the brilliant pigment dispersion (13) is used instead of the brilliant pigment dispersion (1) in the preparation of the oil phase solution (1).

In addition, the brilliant toner (13) is obtained in the same manner as the brilliant toner (1) other than that the oil phase solution (13) is used.

Example 12

The oil phase solution (14) is obtained in the same manner as the oil phase solution (1) other than that the brilliant pigment dispersion (14) is used instead of the brilliant pigment dispersion (1) in the preparation of the oil phase solution (1).

In addition, the brilliant toner (14) is obtained in the same manner as the brilliant toner (1) other than that the oil phase solution (14) is used.

Example 13

The oil phase solution (15) is obtained in the same manner as the oil phase solution (1) other than that the brilliant pigment dispersion (15) is used instead of the brilliant pigment dispersion (1) in the preparation of the oil phase solution (1).

In addition, the brilliant toner (15) is obtained in the same manner as the brilliant toner (1) other than that the oil phase solution (15) is used.

Example 14

Synthesis of Binder Resin

Dimethyl adipate: 74 parts

Dimethyl terephthalate: 192 parts

Ethylene oxide adduct of bisphenol A: 216 parts

Ethylene glycol: 38 parts

Tetrabutoxy titanate (catalyst): 0.037 parts

The above components are put into a heated and dried two-necked flask, the temperature of the components is increased while an inert atmosphere is maintained by introducing nitrogen gas into the container and the components is stirred, co-condensation polymerization reaction is caused at 160° C. for 7 hours, and the temperature is then increased to 220° C. and maintained for 4 hours while the pressure is slowly reduced to 10 Torr. The pressure is returned to the ordinary pressure once, 9 parts of trimellitic anhydride is added thereto, the pressure is slowly reduced again to 10 Torr and is then maintained at 220° C. for 1 hour, and a binder resin is thus synthesized.

The glass transition temperature (Tg) of the binder resin is obtained by measurement under a condition of a temperature increasing speed of 10° C./minute from the room temperature (25° C.) to 150° C. by using a differential scanning calorimetry (DSC-50 manufactured by Shimadzu Corporation). A temperature at an intersection between a baseline and an extended line of a rising line at an endothermic portion is regarded as the glass transition temperature. The glass transition temperature of the binder resin is 63.5° C.

Preparation of Resin Particle Dispersion

Binder resin: 160 parts

Ethyl acetate: 233 parts

Aqueous solution of sodium hydroxide (0.3N): 0.1 parts

The above components are put into a 1000 ml separable flask, are heated at 70°, and stirred by a three one motor (manufactured by Shinto Scientific Co., Ltd.), and a resin mixture solution is prepared. 373 parts of ion exchanged water is slowly added thereto while the resin mixture solution is further stirred at 90 rpm, the mixture is subjected to phase inversion emulsification, the solvent is removed therefrom, and a resin particle dispersion (solid component concentration: 30%) is thus obtained. The volume average particle diameter of the resin particle dispersion is 162 nm.

Preparation of release agent dispersion

Carnauba wax (RC-160 manufactured by Toakasei Co., Ltd.): 50 parts

Anionic surfactant (NEOGEN RK manufactured by DSK Co., Ltd.): 1.0 part

Ion exchanged water: 200 parts

The above components are mixed and heated at 95° C., are dispersed by using a homogenizer (ULTRA-TURRAX T50 manufactured by IKA), and are subjected to dispersion processing for 360 minutes by using a MANTON GAULIN high-pressure homogenizer (manufactured by Manton Gaulin Manufacturing Co., Inc.), and a release agent dispersion (solid component concentration: 20%) in which release agent particles with a volume average particle diameter of 0.23 μm are dispersed is prepared.

Preparation of Toner (16)

Binder resin dispersion: 480 parts

Release agent dispersion: 72 parts

Brilliant pigment dispersion (1): 140 parts

Nonionic surfactant (IGEPAL CA 897): 1.40 parts

The above raw materials are placed in a 2 L cylindrical stainless steel container and are dispersed and mixed for 10 minutes while shear force is applied at 4000 rpm by a homogenizer (ULTRA-TURRAX T50 manufactured by IKA). Then, 1.75 parts of 10% nitric acid solution of aluminum polychloride as an aggregating agent is slowly dropped thereto, the mixture is dispersed and mixed for 15 minutes by setting the rotational speed of the homogenizer to 5000 rpm, and a raw material dispersion is thus obtained.

Thereafter, the raw material dispersion is moved to a polymerization tank provided with a stirrer using two-paddle stirring blades and a thermometer, heating by a mantle heater is started while setting the stirring rotation speed to 810 rpm, and growth of the aggregated particles is promoted at 54° C. At this time, pH of the raw material dispersion is controlled within a range from 2.2 to 3.5 by 0.3N of nitric acid and 1N of sodium hydroxide solution. The raw material dispersion is maintained in the pH range for about 2 hours, and aggregated particles are formed.

Next, 100 parts of binder resin dispersion is additionally added, and resin particles of the binder resin are made to attach to the surfaces of the aggregated particles. The temperature is further increased to 56° C., and aggregated particles are organized while the particle diameters are observed by an optical microscope and a Multisizer II. Thereafter, pH is increased to 8.0 to coalesce the aggregated particles, and the temperature is then increased to 67.5° C. After checking that the aggregated particles have been coalesced by the optical microscope, pH is lowered to 6.0 while the temperature is maintained at 67.5° C., and the heating is stopped 1 hour later, and cooling is performed at a temperature lowering speed of 1.0° C./minute. Thereafter, the particles are classified with a mesh of 20 μm, are repeatedly washed with water, and are dried by a vacuum dryer, and toner particles are obtained. The volume average particle diameter of the obtained toner particles is 11.5 μm.

1.5 parts of hydrophobic silica (RY50 manufactured by Nippon Aerosil Co., Ltd.) is mixed and blended with respect to 100 parts of the obtained toner particles at 10,000 rpm for 30 seconds by using a sample mill. Thereafter, the toner particles are classified with a vibration classifier with a mesh of 45 μm, and toner is thus prepared.

TABLE 1

| Brilliant pigment dispersion | Average thickness (μm) | Volume average particle diameter (μm) | Upper GSD | Lower GSD | Aspect ratio |
|---|---|---|---|---|---|
| 1 | 1.0 | 6.5 | 1.25 | 1.26 | 6.5 |
| 2 | 0.6 | 6.6 | 1.23 | 1.23 | 11.0 |
| 3 | 1.4 | 7.7 | 1.25 | 1.25 | 5.5 |
| 4 | 0.4 | 7.8 | 1.30 | 1.33 | 19.5 |
| 5 | 1.8 | 7.8 | 1.33 | 1.32 | 4.3 |
| 6 | 1.2 | 12 | 1.28 | 1.30 | 10.0 |
| 7 | 0.8 | 2.4 | 1.28 | 1.28 | 3.0 |
| 8 | 1.0 | 22 | 1.30 | 1.28 | 22.0 |
| 9 | 1.0 | 6.7 | 1.48 | 1.33 | 6.7 |
| 10 | 1.0 | 6.4 | 1.32 | 1.51 | 6.4 |
| 11 | 1.0 | 3.2 | 1.24 | 1.25 | 3.2 |
| 12 | 0.7 | 23 | 1.23 | 1.22 | 32.9 |
| 13 | 0.9 | 27 | 1.35 | 1.33 | 30.0 |
| 14 | 1.1 | 3.0 | 1.30 | 1.31 | 2.7 |
| 15 | 0.6 | 25 | 1.31 | 1.31 | 41.3 |

Preparation of Carrier

Ferrite particles (volume average particle diameter: 35 μm): 100 parts

Toluene: 14 parts

Methyl methacrylate-perfluorooctylethyl acrylate copolymer (critical surface tension: 24 dyn/cm): 1.6 parts Carbon black (product name: VXC-72 manufactured by Cabot Corporation, volume resistivity: equal to or less than 100 Ωcm): 0.12 parts Crosslinked melamine resin particles (average particle diameter: 0.3 μm, toluene insoluble): 0.3 parts First, carbon black is diluted in toluene, the mixture is added to the methyl methacrylate-perfluorooctylethyl acrylate copolymer and is dispersed in a sand mill. Then, the above respective components other than the ferrite particles are dispersed for 10 minutes by a stirrer, and a solution for forming a covering layer is obtained. Then, the solution for forming the covering layer and the ferrite particles are put into a vacuum degassing-type kneader, and the mixture is stirred at 60° C. for 30 minutes. Then, the pressure is reduced, toluene is evaporated, a resin covering layer is formed, and a carrier is thus obtained.

Preparation of Developer 36 parts of brilliant toner obtained in each of the examples, 414 parts of carrier are put into a 2-liter V blender, the mixture is stirred for 20 minutes and are then classified with a mesh of 212 μm, and a developer is thus prepared.

Contamination of Toner Image

A developing machine of "modified machine Color 800 Press" manufactured by Fuji Xerox Co., Ltd. is filled with the obtained developer. In addition, a developing machine, which is different from the developing machine for the developer containing the brilliant toner, is filled with a commercially available black developer.

The modified machine is used to output solid images on 10,000 OK TOP COAT sheets (basis weight: 127, manufactured by Oji Paper Co., Ltd.) by using the brilliant toner with a brilliant toner applied amount of 4.0 g/m$^2$.

After the 10,000th solid image is output by using the brilliant toner, a single solid image with a black toner applied amount of 4.5 g/m$^2$ is output in 10 seconds.

The brilliant toner applied on the solid image by the black toner is visually observed and evaluated based on the following criteria. Obtained results will be shown in Table 2.

Criteria

G1: No brilliant particle is observed.

G2: Although several pieces of the brilliant particles are present, the image is allowable.

G3: Multiple pieces of the brilliant particles are present, and the image is not allowable.

Ratio (X/Y)

A spectroscopic variable-angle colorimeter GC5000L manufactured by Nippon Denshoku Industries Co., Ltd. is used as a varied-angle photometer to cause incident light with an incident angle −45° with respect to the 10,000th solid image output by using the brilliant toner to be incident on the solid image, and reflectance X at a light receiving angle +30° and reflectance Y at a light receiving angle −30° are measured. The reflectance X and the reflectance Y are measured from light within a wavelength range from 400 nm to 700 nm at an interval of 20 nm, and average values of the reflectance at the respective wavelengths are obtained. The ratio (X/Y) is calculated from these measurement results. The results will be shown in Table 2.

As the ratio (X/Y) increases, the glossy feeling increases. As the ratio (X/Y) decreases, dull-hued tone increases, and the glossy feeling decreases.

Table 2 also shows volume average particle diameters and aspect ratios of the toner particles.

TABLE 2

| | Contamination | Ratio (X/Y) | Volume average particle diameter (μm) | Aspect ratio |
|---|---|---|---|---|
| Example 1 | G1 | 6.0 | 12.0 | 6.0 |
| Example 2 | G2 | 12 | 12.1 | 8.1 |

TABLE 2-continued

| | Contamination | Ratio (X/Y) | Volume average particle diameter (μm) | Aspect ratio |
|---|---|---|---|---|
| Example 3 | G1 | 3.0 | 13.0 | 3.7 |
| Example 4 | G1 | 2.6 | 15.0 | 5.0 |
| Example 5 | G1 | 4.3 | 5.1 | 3.0 |
| Example 6 | G1 | 25 | 25.0 | 8.3 |
| Example 7 | G1 | 6.8 | 12.1 | 6.1 |
| Example 8 | G1 | 5.7 | 11.7 | 5.9 |
| Example 9 | G1 | 3.2 | 6.8 | 4.5 |
| Example 10 | G2 | 27 | 26.8 | 5.4 |
| Example 11 | G2 | 30 | 31.0 | 6.2 |
| Example 12 | G1 | 3.0 | 6.5 | 2.2 |
| Example 13 | G2 | 27 | 27.0 | 13.5 |
| Example 14 | G1 | 8.5 | 11.5 | 6.4 |
| Comparative Example 1 | G3 | 15 | 13.2 | 12.0 |
| Comparative Example 2 | G3 | 1.6 | 13.4 | 3.4 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A brilliant toner comprising:

toner particles that contain a binder resin and a brilliant pigment which has a flake shape, wherein an average thickness of the brilliant pigment is greater than 0.5 μm and is equal to or less than 1.5 μm, wherein the binder resin is a polyester resin formed from terephthalic acid, ethylene oxide adduct of bisphenol A, and propylene oxide adduct of bisphenol A, and wherein the metal pigment is an aluminum pigment.

2. The brilliant toner according to claim 1, wherein a volume average particle diameter of the brilliant pigment is from 1.0 μm to 25 μm.

3. The brilliant toner according to claim 1, wherein the brilliant pigment is a metal pigment.

4. The brilliant toner according to claim 1, wherein a toluene insoluble portion other than inorganic matters is from 0.1% by weight to 50% by weight with respect to the entire of the brilliant toner.

5. The brilliant toner according to claim 1, wherein the binder resin is polyester resin having a glass transition temperature of 50° C. to 80° C.

6. The brilliant toner according to claim 1, wherein the binder resin is polyester resin having a weight average molecular weight (Mw) of 5,000 to 1,000,000.

7. The brilliant toner according to claim 1, wherein an upper GSD of an average thickness of the brilliant pigment is equal to or less than 1.4.

8. The brilliant toner according to claim 1, wherein a lower GSD of an average thickness of the brilliant pigment is equal to or less than 1.4.

9. The brilliant toner according to claim 1, wherein an aspect ratio of the brilliant pigment is from 3 to 40.

10. The brilliant toner according to claim 1, wherein a volume average particle diameter of the toner particles is from 3μm to 30μm.

11. The brilliant toner according to claim 1, wherein an aspect ratio of the toner particles is from 3 to 15.

12. The brilliant toner according to claim 1, wherein a ratio (D50(pig)/D50(tn)) of a volume average particle diameter (D50(pig)) of the brilliant pigment and a volume average particle diameter(D50(tn)) of the toner particles is from 0.46 to 0.93.

13. The brilliant toner according to claim 1, wherein a ratio (A(pig)/A(tn)) of an aspect ratio (A(pig)) of the brilliant pigment and an aspect ratio (A(tn)) of the toner particles is from 0.71 to 6.08.

14. The brilliant toner according to claim 1, wherein the binder resin contains urea-modified polyester resin.

15. An electrostatic charge image developer comprising:

the brilliant toner according to claim 1.

16. A toner cartridge comprising:

a container that contains the brilliant toner according to claim 1, wherein the toner cartridge is detachable from an image forming apparatus.

17. A brilliant toner comprising:

toner particles that contain a binder resin and a brilliant pigment which has a flake shape, wherein an average thickness of the brilliant pigment is greater than 0.5 μm and is equal to or less than 1.5 μm, wherein the binder resin is a polyester resin formed from terephthalic acid, ethylene oxide adduct of bisphenol A, and propylene oxide adduct of bisphenol A, wherein the metal pigment is an aluminum pigment, wherein an aspect ratio of the brilliant pigment is from 3 to 33, wherein a volume average particle diameter of the toner particles is from 5 μm to 31 μm, and wherein an aspect ratio of the toner particles is from 2.2 to 13.5.

* * * * *